US008819896B2

(12) United States Patent
Kellum, III et al.

(10) Patent No.: US 8,819,896 B2
(45) **Date of Patent: *Sep. 2, 2014**

(54) LOCKING CARRIER AND MOUNTING ARRANGEMENT FOR TILT SASH COUNTERBALANCE SYSTEMS

(71) Applicant: Caldwell Manufacturing Company North America, LLC, Rochester, NY (US)

(72) Inventors: Wilbur James Kellum, III, Hilton, NY (US); Eric Mertz, Webster, NY (US); Mark R. Baker, Rochester, NY (US); Jeffrey Tuller, Rochester, NY (US); Richard S. DeNormand, Victor, NY (US); Fletcher Smith, Hagerstown, MD (US); Jay Sofianek, Webster, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/930,290

(22) Filed: Jun. 28, 2013

(65) Prior Publication Data

US 2013/0283699 A1 Oct. 31, 2013

Related U.S. Application Data

(63) Continuation-in-part of application No. 13/576,440, filed as application No. PCT/US2011/024134 on Feb. 9, 2011, now Pat. No. 8,561,260.

(60) Provisional application No. 61/302,722, filed on Feb. 9, 2010, provisional application No. 61/302,715, filed on Feb. 9, 2010, provisional application No. 61/665,558, filed on Jun. 28, 2012.

(51) Int. Cl.
*E05D 13/00* (2006.01)

(52) U.S. Cl.
USPC ..... 16/193; 16/197; 16/401; 16/DIG. 16

(58) Field of Classification Search
USPC ..... 16/193, 197, 400, 401, DIG. 16
See application file for complete search history.

(56) References Cited

U.S. PATENT DOCUMENTS

| | | | | |
|---|---|---|---|---|
| 5,353,548 | A | 10/1994 | Westfall | |
| 6,802,105 | B2 * | 10/2004 | Polowinczak et al. | 16/198 |
| 6,983,513 | B2 * | 1/2006 | Pettit | 16/197 |
| 7,587,787 | B2 * | 9/2009 | Pettit | 16/197 |
| 7,735,191 | B2 | 6/2010 | Tuller | |
| 2008/0120804 | A1 * | 5/2008 | Annes et al. | 16/198 |
| 2009/0260295 | A1 * | 10/2009 | Tuller | 49/445 |

FOREIGN PATENT DOCUMENTS

WO WO 2011/100280 8/2011

* cited by examiner

*Primary Examiner* — Roberta Delisle
(74) *Attorney, Agent, or Firm* — Harness, Dickey & Pierce, P.L.C.

(57) ABSTRACT

A window balance assembly comprising an improved locking carrier mechanism is disclosed. The locking mechanism is actuated when the window sash is tilted. Cam surfaces on the receiver of the mechanism engage cam followers in the clamshell-type housing of the carrier forcing them apart outwardly to lock the carrier in the jamb channel of a window assembly and prevent movement of the carrier in the channel. The receiver incorporates two cams that engage two cam follower surfaces in the housing to improve the distribution of the locking forces of the carrier in the jamb channel. A dual-locking carrier expands in both the axial and lateral directions to contact both front and back surfaces and opposing side surfaces of the jamb channel.

21 Claims, 16 Drawing Sheets

LOCKING CARRIER AND MOUNTING ARRANGEMENT FOR TILT SASH COUNTERBALANCE SYSTEMS

CROSS-REFERENCE TO RELATED APPLICATIONS

This application is a continuation-in-part of U.S. patent application Ser. No. 13/576,440, filed on Aug. 1, 2012, which is a National Stage of International Application No. PCT/US2011/024134, filed on Feb. 9, 2011, which claims the benefit of U.S. Provisional Application No. 61/302,722, filed on Feb. 9, 2010 and U.S. Provisional Application No. 61/302,715, filed on Feb. 9, 2010. This application also claims the benefit of U.S. Provisional Application No. 61/665,558, filed on Jun. 28, 2012. The entire disclosures of each of the above applications are incorporated herein by reference.

FIELD

The present disclosure relates to window balance assemblies. More particularly, the invention pertains to window balance hardware and locking apparatus for balance carriers.

BACKGROUND

This section provides background information related to the present disclosure which is not necessarily prior art.

Modern window assemblies in residential, commercial and industrial buildings may include one or more window sashes that are movable vertically within a window jamb. Window sashes that move vertically to open and close often include two or more window balance assemblies. The balance assemblies urge the window sash upward (i.e., toward an open position for a lower sash or toward a closed position for an upper sash) to assist a user in moving the window sash and to retain the window sash at a position selected by the user.

Locking mechanisms to lock the carrier (also known as a "shoe") in the jamb channels when the sash of a tilt-sash window assembly is tilted are known in the art. U.S. Pat. No. 5,353,548, entitled "CURL SPRING SHOE BASED WINDOW BALANCE SYSTEM", issued Oct. 11, 1994 to Westfall, discloses a window balance system for a tilt-sash window assembly having a pair of constant force curl springs having curled convolutions carried by sash shoes and free end regions mounted in sash shoe channels above the region of travel of the shoes. The curl tendency of the springs imparts a lift to the curled spring convolutions, and the shoes transmit the lift to the sash. The springs curl into the convolutions as the shoes rise, and the springs uncurl from the shoes into the shoe channels when the shoes move downward. A single annular cam on a receiver in the shoe locks the shoe in the shoe channel when the sash is tilted outward. The receiver has an opening which receives a pin or pivot bar connected to the sash such that when the sash is tilted, the receiver rotates with the sash, whereby the cam rotates to separate the two body parts of the shoe body such that they bind against the shoe channel to prevent upward or downward movement of the shoe while the sash is tilted. The disclosure of U.S. Pat. No. 5,353,548 is hereby incorporated herein in its entirety.

SUMMARY

This section provides a general summary of the disclosure, and is not a comprehensive disclosure of its full scope or all of its features.

The disclosure provides a window balance assembly with an improved locking carrier mechanism that is actuated by rotation of the pivot bar when the window sash is tilted. Cams on the receiver of the mechanism engage cam followers in the clamshell-type housing of the carrier forcing them apart outwardly to lock the carrier in the jamb channel of a window assembly and prevent movement of the carrier in the channel. The receiver incorporates cams that engage cam follower surfaces in the housing to improve the distribution of the locking forces of the carrier in the jamb channel. A dual locking carrier expands in both the axial and lateral directions to contact both front and back surfaces and opposing side surfaces of the jamb channel.

In one aspect, the disclosure provides a moving coil window balance assembly for installation in a window assembly having a carrier, a curl spring and a mounting bracket. In certain embodiments, the carrier has a clamshell-type housing and a receiver. The housing has opposing first and second housing portions and contains the curl spring. The housing includes a first aperture extending therethrough along a first axis and located proximate to a bottom end of the housing. In addition, the housing has arcuate recesses that at least partially surround the first aperture, and axial cam followers.

The receiver is rotatably engaged in the aperture. The receiver is a generally cylindrical member including slotted recesses formed in each end, and having two symmetric, annular cams extending around a portion of its perimeter.

When the receiver is in a first rotational (unlocked) position, the cams are received in the recesses and the first and second housing portions are closed against one another at the bottom end of the housing. When the receiver is in a second (locked) rotational position, the cams on the receiver engage the axial cam followers (e.g., interior faces of the first and second housing portions) and displace the first and second housing portions away from one another at the bottom end of the housing in a direction along the first axis (e.g., an axial direction).

In another aspect of the disclosure, the housing includes an insert comprising a friction enhancing feature that protrudes from an exterior face of the housing that is perpendicular to the first axis.

In still another aspect of the disclosure, the housing further includes lateral cam followers. When the receiver is in a second rotational position, the receiver engages the axial cam followers and displaces the first and second housing portions away from one another at the bottom end of the housing in a direction along the first axis (e.g., an axial direction). In addition, the receiver engages the lateral cam followers and displaces the first and second housing portions away from one another at the bottom end of the housing in a direction along a second axis that is generally perpendicular to the first axis (e.g., a lateral direction).

In still another aspect of the disclosure, the first and second housing portions include lateral cam followers extending from their interior faces adjacent to the first aperture. When the receiver is in a second rotational position, the cams engage the interior faces of the first and second housing portions and displace the first and second housing portions away from one another at the bottom end of the housing in a direction along the first axis, and the cams engage the lateral cam followers of the first and second housing portions and displace the first and second housing portions away from one another at the bottom end of the housing in a direction along a second axis that is generally perpendicular to the first axis.

In an alternate configuration, an insert is disposed in second apertures formed in the first and second housing portions. The insert serves as a lateral cam follower and further includes a friction enhancing feature that protrudes from exterior faces of the first and second housing portions.

In a still further aspect of the disclosure, the housing has at least one opening near the first aperture and a locking pad is mounted in the opening. The locking pad has a rear cam follower and a forward surface. When the receiver is in a first rotational position, the locking pad is in a first retracted position in the housing. When the receiver is in a second rotational position, the cam engages the cam follower of the locking pad and the locking pad is in a second extended position wherein the forward surface extends from the housing.

In yet another aspect of the disclosure, the mounting bracket comprises a body portion having a back wall and at least one side wall. A spring attachment portion is located at an upper end of the side wall for engaging the curl spring. A mounting hook extends from an upper portion of the back wall and a tab member extends from a lower portion of the back wall. The mounting bracket also includes an attachment portion for connecting to the upper end of the carrier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings, as appropriate.

DETAILED DESCRIPTION

Example embodiments will now be described more fully with reference to the accompanying drawings.

Figure 1:
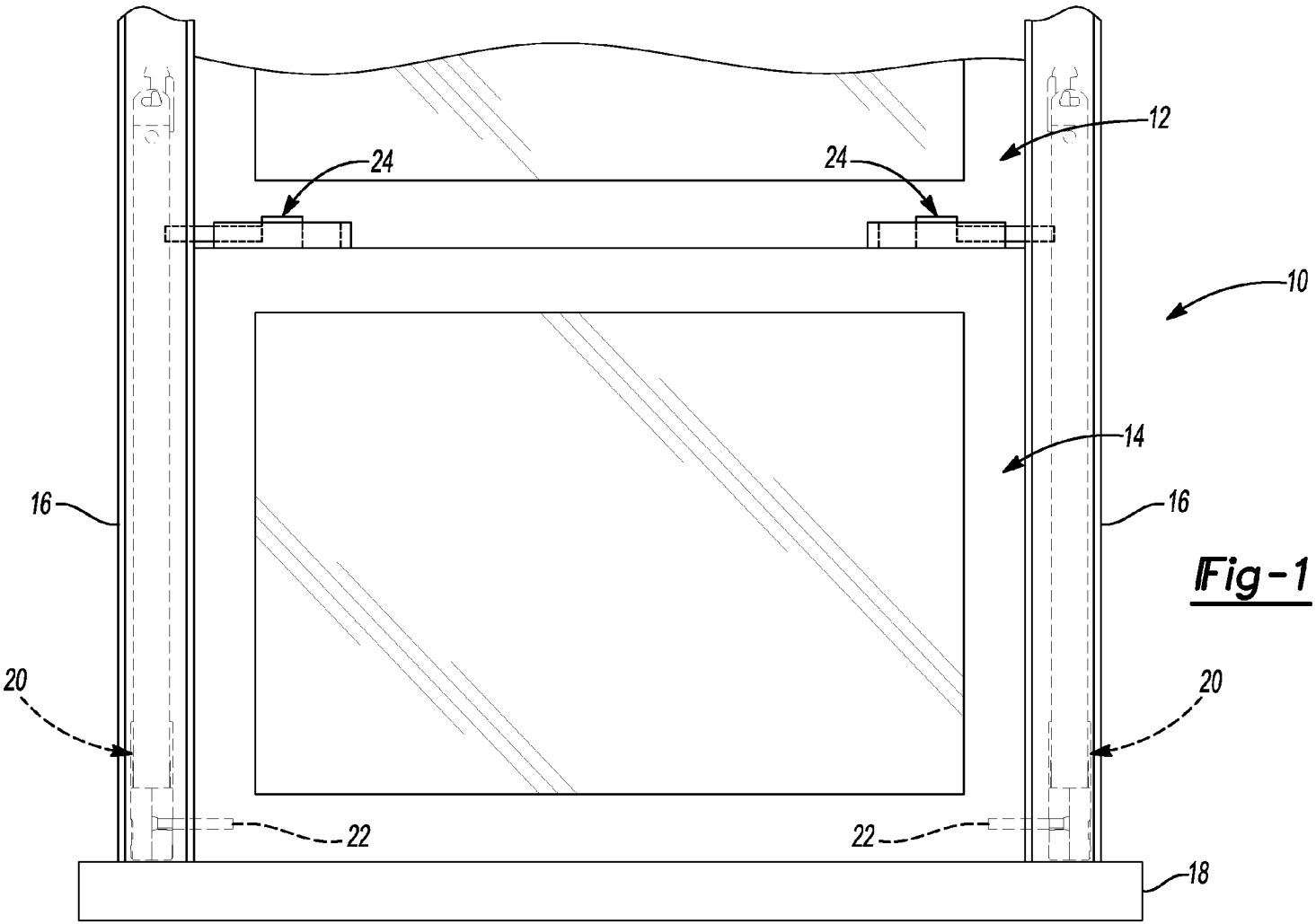
FIG. 1 is a partial schematic front view of a window assembly including window balance assemblies according to the principles of the present disclosure.
Figure 2:
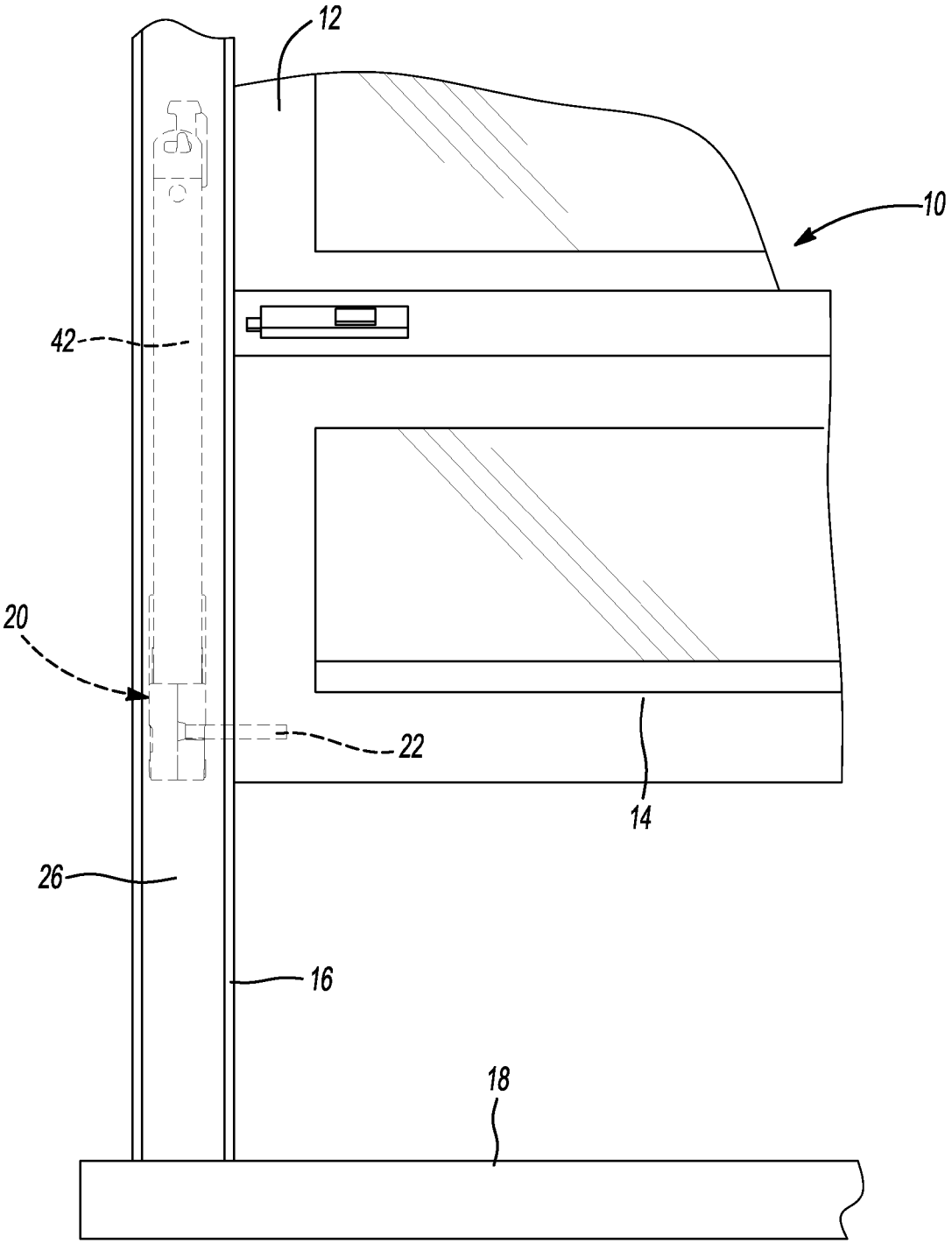
FIG. 2 is a partial schematic front view of the window assembly of FIG. 1 showing a raised and tilted window sash.
Figure 3:
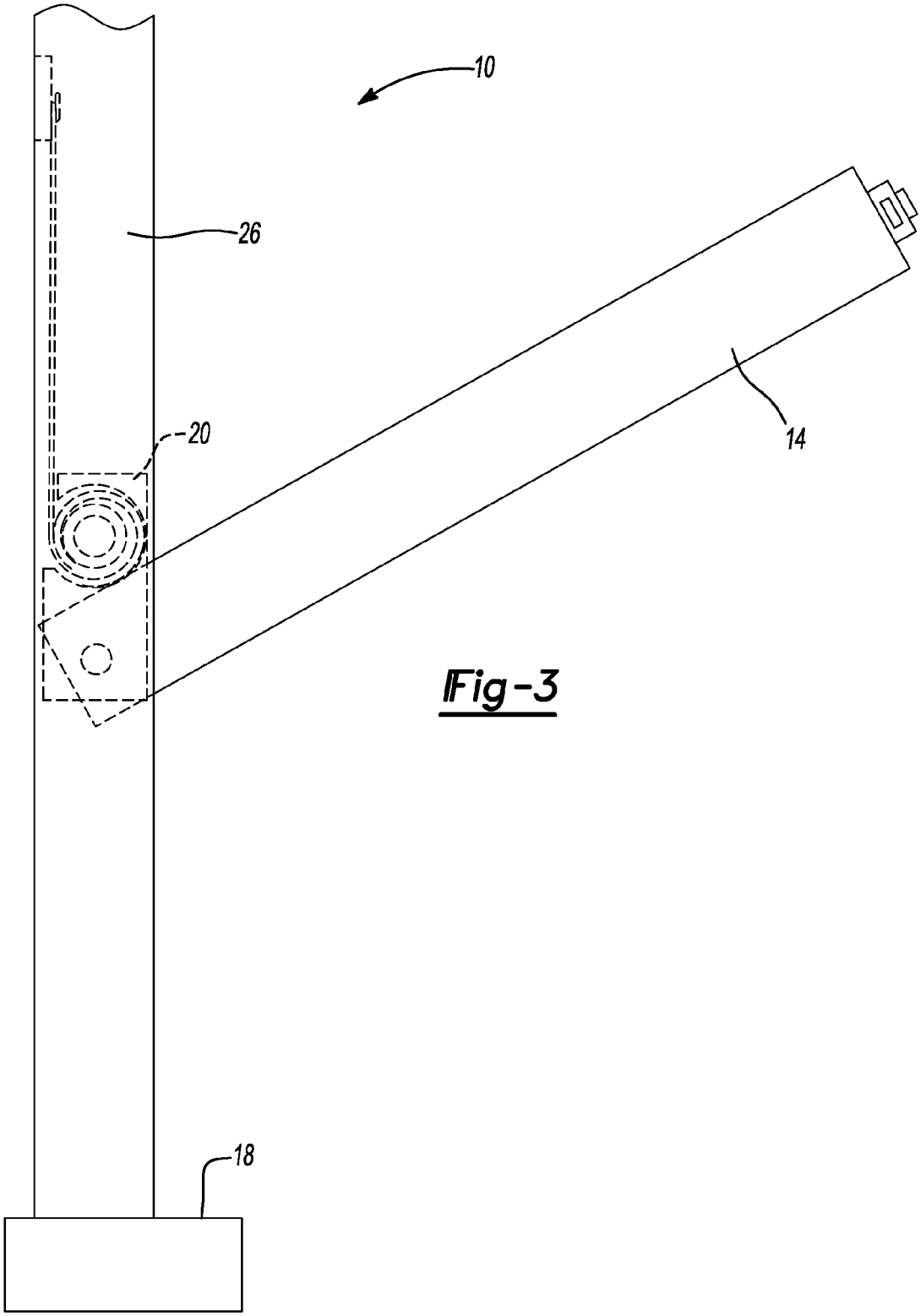
FIG. 3 is a partial schematic side view of the window assembly of FIG. 2.

With reference to FIGS. 1-3, a window assembly 10 is provided that may include an upper sash 12, a lower sash 14, a pair of window jambs 16, a window sill 18, and two or more window balance assemblies 20. In the particular embodiment illustrated in FIG. 1, the upper sash 12 is fixed relative to the window sill 18 (i.e., in a single hung window assembly). However, in some embodiments, the upper sash 12 may be movable relative to the window sill 18 between a raised or closed position and a lowered or open position (i.e., in a double hung window assembly). The lower sash 14 may be raised and lowered between open and closed positions and may be connected to the window balance assemblies 20 which assist a user in opening the lower sash 14 and maintain the lower sash 14 in a desired position relative to the window sill 18.

The lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20, as will be subsequently described. The tilt latch mechanisms 24 may extend laterally outward in opposing directions from an upper portion of the lower sash 14 and may selectively engage corresponding ones of the window jambs 16. The tilt latch mechanisms 24 may be selectively actuated to allow the lower sash 12 to pivot about the pivot bars 22 relative to the window jambs 16 to facilitate cleaning of an exterior side of the window assembly 10, for example.

It will be appreciated that in a double hung window assembly, the upper sash 12 may also be connected to two or more window balance assemblies to assist the user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Figure 7:
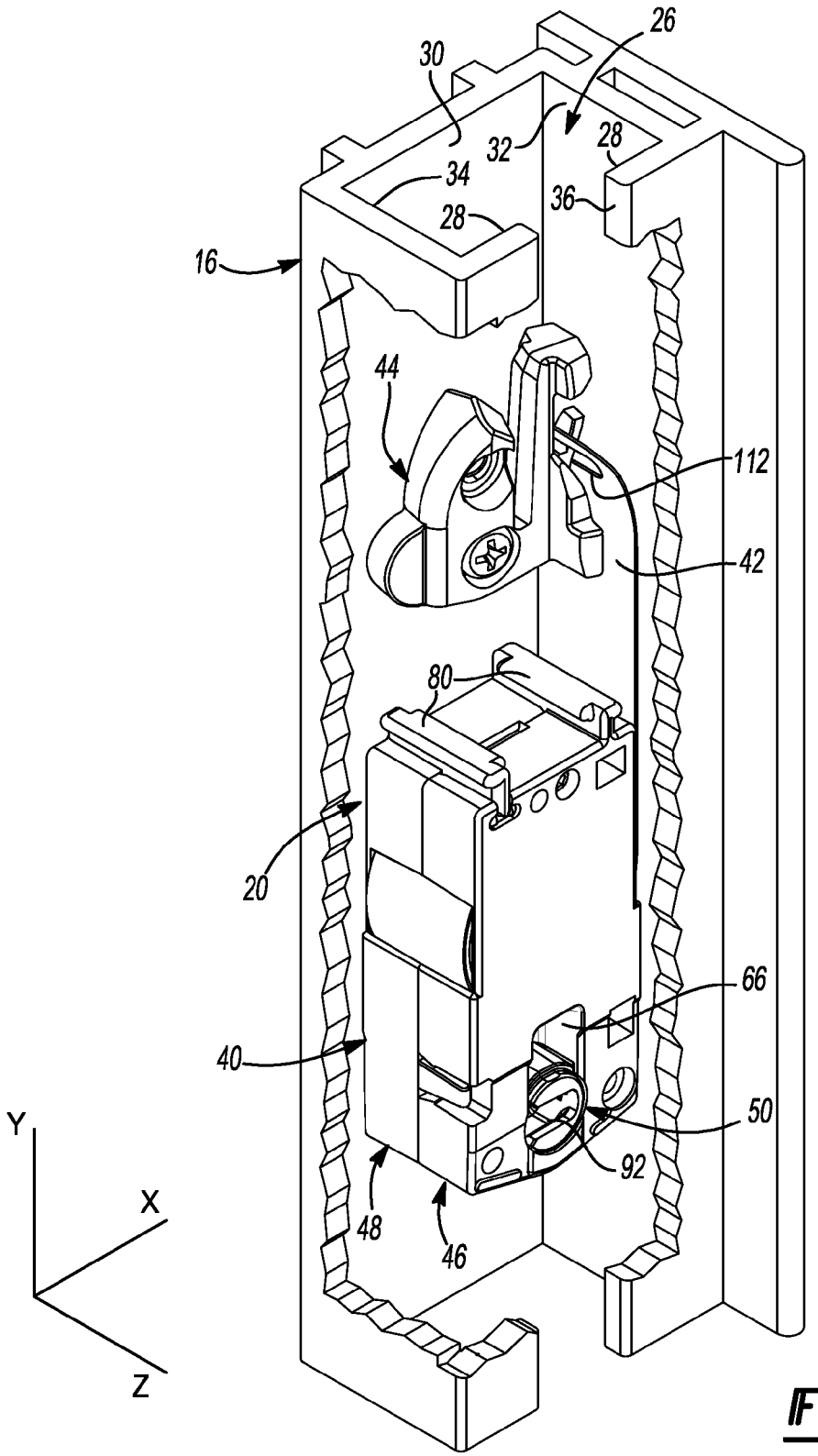
FIG. 7 is a partially cut-away perspective view of the window balance assembly of FIG. 4 installed in a window jamb according to the principles of the present disclosure.

Each of the window jambs 16 may include a jamb channel 26 defined by a first wall 28, a second wall 30 opposite the first wall 28, and third and fourth walls 32, 34 disposed perpendicular to the first and second walls 28, 30 (FIG. 7). The first wall 28 may include a vertically extending slot 36 adjacent the lower sash 14. The window balance assembly 20 may be installed within the jamb channel 26. The pivot bar 22 may extend through the slot 36 and into the jamb channel 26 to engage the window balance assembly 20. The tilt latch mechanism 24 may also selectively engage the slot 36 to lock the lower sash 14 in an upright position (FIG. 1).

The window balance assemblies include a carrier (also referred to as a shoe), a biasing member that provides the counterbalancing force against the weight of the window sash, and a mounting bracket that attaches one end of the balance assembly to the window jamb. Referring to the figures, in the embodiments shown, balance assemblies 20 may include a carrier 40, a curl spring 42, and a mounting bracket 44. The configuration shown is a so-called "moving coil" constant force balance assembly; however, other types of balance assemblies can employ the locking carrier of this disclosure.

The window balance assemblies 20 may be initially assembled and shipped in an uninstalled or shipping configuration (shown in FIGS. 4 and 5) and may be subsequently installed onto the window assembly 10 and placed in an installed configuration (shown in FIG. 7) by a window manufacturer, a construction or renovation contractor, or a homeowner, for example.

Figure 6:
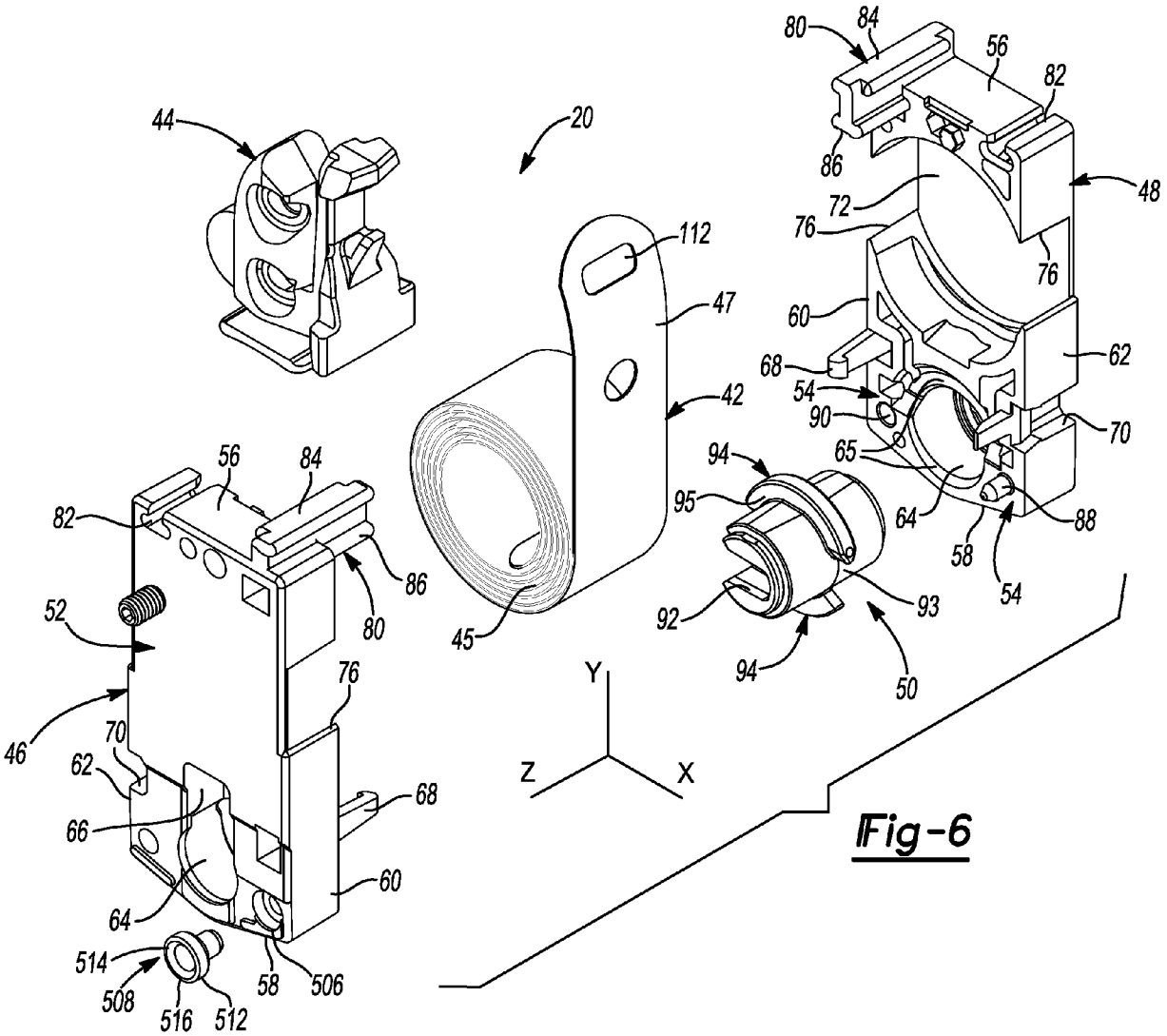
FIG. 6 is an exploded perspective view of the window balance assembly of FIG. 4.

Referring to FIGS. 6 and 7, the carrier 40 may engage the lower sash 14 and house a curled portion 45 of the curl spring 42. The mounting bracket 44 may engage an uncurled end portion 47 of the curl spring 42 and may be fixed relative to the window jamb 16, as shown in FIG. 7. The curl spring 42 may resist being uncurled such that the curl spring 42 exerts an upward force on the carrier 40, thereby biasing the lower sash 14 toward the open position.

Again with reference to FIG. 6, the carrier 40 may include a first housing portion 46, a second housing portion 48, and a receiver 50. The first and second housing portions 46, 48 may be identical components that fit together to form a clamshell-type housing for the curl spring 42 and the receiver 50. Forming the first and second housing portions 46, 48 as identical components can reduce the total number of different individual components that must be manufactured and facilitate poka-yoke assembly of the carrier 40. That is, assembly of the carrier 40 is simplified in that a worker need not be concerned with selecting the correct one of each of a pair of different mating components to assemble together.

Each of the first and second housing portions 46, 48 may include an exterior face 52, an interior face 54, a top end 56, a bottom end 58, a first side 60, and a second side 62. An aperture 64 disposed proximate the bottom end 58 may extend through the exterior and interior faces 52, 54 and may rotatably engage the receiver 50. Arcuate recesses 65 formed in the interior face 54 may be concentric with the aperture 64 and may partially surround the aperture 64. A first slot 66 in communication with the aperture 64 may be formed in the exterior face 52 and may extend vertically upward along the Y-axis (see, e.g., FIG. 5) from the aperture 64.

A barbed protuberance 68 may be disposed at or proximate to the first side 60 and may extend outward from the interior face 54. A second slot 70 may be formed in the second side 62 generally opposite the barbed protuberance 68 such that when the first and second housing portions 46, 48 are assembled together, the barbed protuberances 68 may engage the second slots 70 (shown best in FIG. 4). The length of the barbed protuberance 68 may be sufficient to allow the first and second housing portions 46, 48 to move relative to each other between a first unlocked position and a second locked position without disengaging each other.

The interior face 54 may include generally cylindrical recesses 72. When the first and second housing portions 46, 48 are assembled together, the cylindrical recesses 72 cooperate with each other to form a nest that receives the curled portion 45 of the curl spring 42. Openings 76 in communication with the recess 72 may be formed in the first and second sides 60, 62 through which the uncurled portion 47 of the curl spring 42 may extend toward the mounting bracket 44.

The first and second housing portions 46, 48 may also include a projection 80 and a third slot 82 disposed at the top end 56. The projection 80 may extend from the exterior face 52 beyond the interior face 54 and may include a generally I-shaped cross-section having upper and lower flanges 84, 86. The third slots 82 may be sized and shaped to enable the third slots 82 of the first housing portion 46 and the second housing portion 48 to slidably engage the lower flanges 86 of the second housing portion 48 and the first housing portion 46, respectively. In a similar manner, pegs 88 and apertures 90 formed in the interior face 54 of the first and second housing portions 46, 48 may be sized and positioned to slidably engage each other when the first and second housing portions 46, 48 are assembled together.

Figure 9:
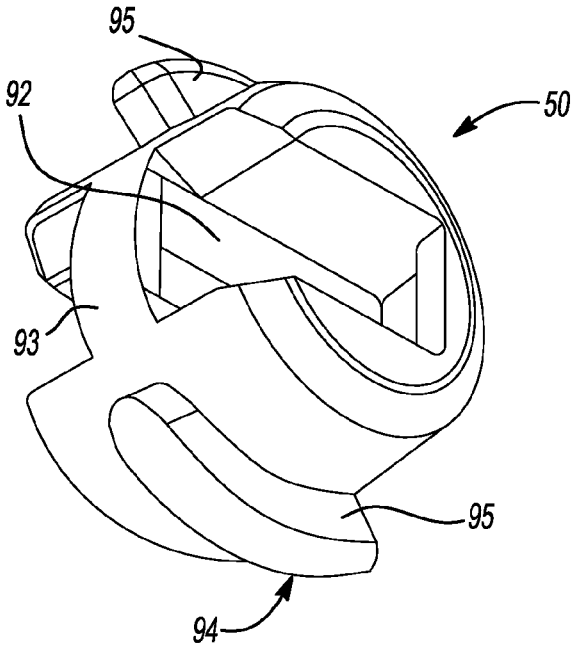
FIG. 9 is a perspective view of an exemplary receiver for use with a window balance assembly according to the principles of the present disclosure.

As illustrated in FIGS. 6 and 9, the receiver 50 may be a generally cylindrical member including slotted recesses 92 formed in each end thereof and have two symmetric, annular cams 94 extending around a portion of the perimeter of the receiver 50. One of the recesses 92 of each of the window balance assemblies 20 may receive a corresponding one of the pivot bars 22 extending from the lower sash 14. As described above, the receiver 50 may be rotatable within the aperture 64 to allow the lower sash 14 to pivot about the pivot bar 22 between an upright position and a tilted position. The angular span of the cams 94 may correspond to the angular span of the arcuate recesses 65 that partially surround the aperture 64 in the first and second housing portions 46, 48 such that when the lower sash 14 is in the upright position, the cams 94 fits within the arcuate recesses 65. As shown, gaps 93 between the cams 94 comprise the generally cylindrical exterior of the receiver 50. Alternatively, the cams 94 may be arcuately abridged by thin rib portions (not shown) that do not engage the arcuate recesses 65 and lie adjacent to the interior faces 54 of the first and second housing portions 46, 48.

Figure 4:
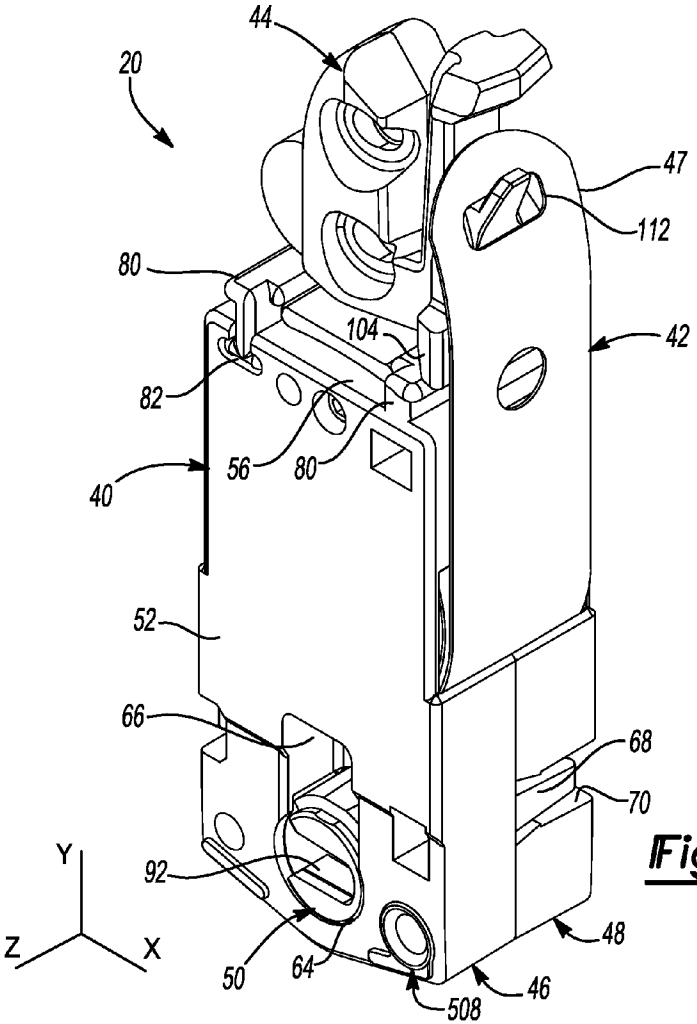
FIG. 4 is a perspective view of an exemplary window balance assembly including a locking carrier in an uninstalled configuration according to the principles of the present disclosure.
Figure 8:
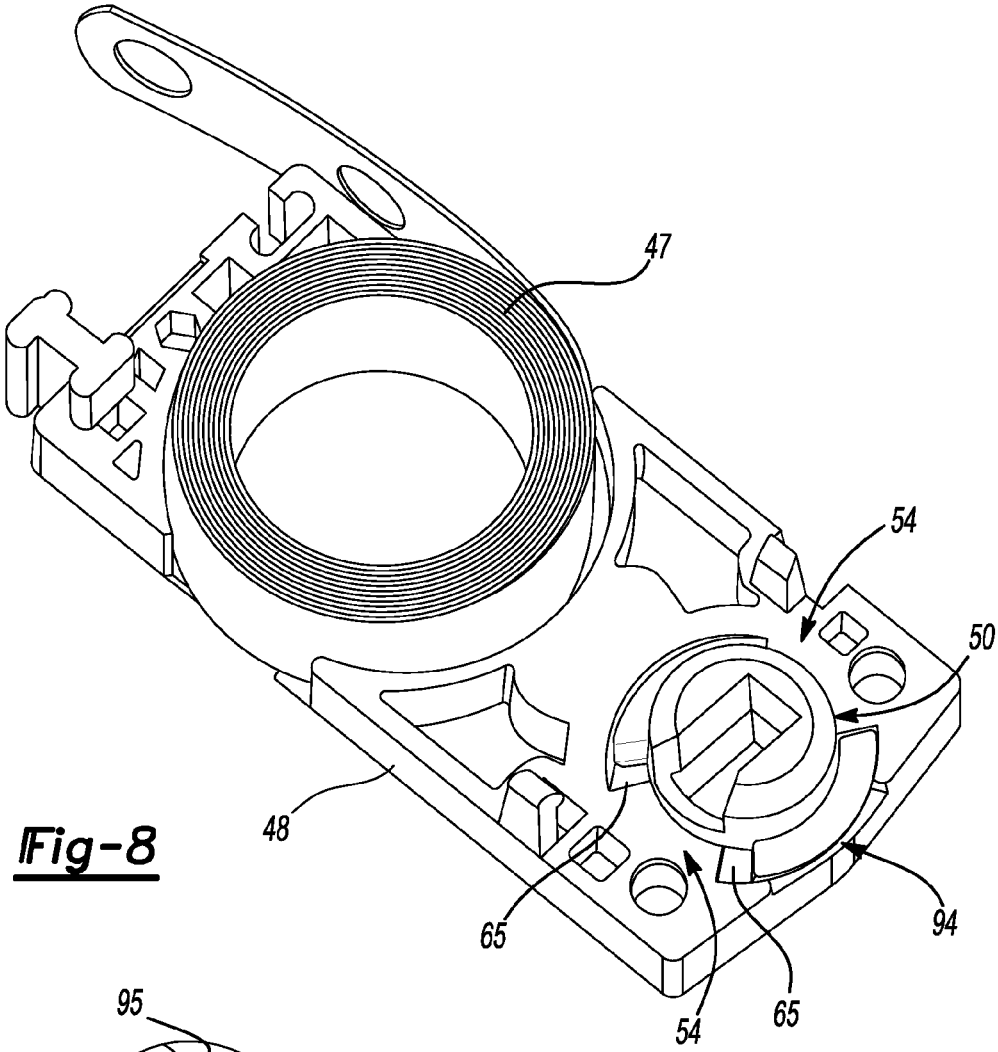
FIG. 8 is a perspective view of an exemplary carrier assembly for use with a window balance assembly according to the principles of the present disclosure having a housing portion removed.

When the receiver 50 is oriented such that the slotted recess 92 is oriented horizontally relative to the carrier 40 (i.e., along the X-axis), the cams 94 may be fully received within the arcuate recesses 65 (see FIGS. 4 and 8). When the cams 94 are received in the arcuate recesses 65, the first and second housing portions 46, 48 are allowed to fully close together. In this configuration, the carrier 40 is in an unlocked or unrestricted position, such that the carrier 40 may be generally unrestricted from moving upward and downward in the window jamb 16 as the lower sash 14 moves between the open and closed positions.

Figure 5:
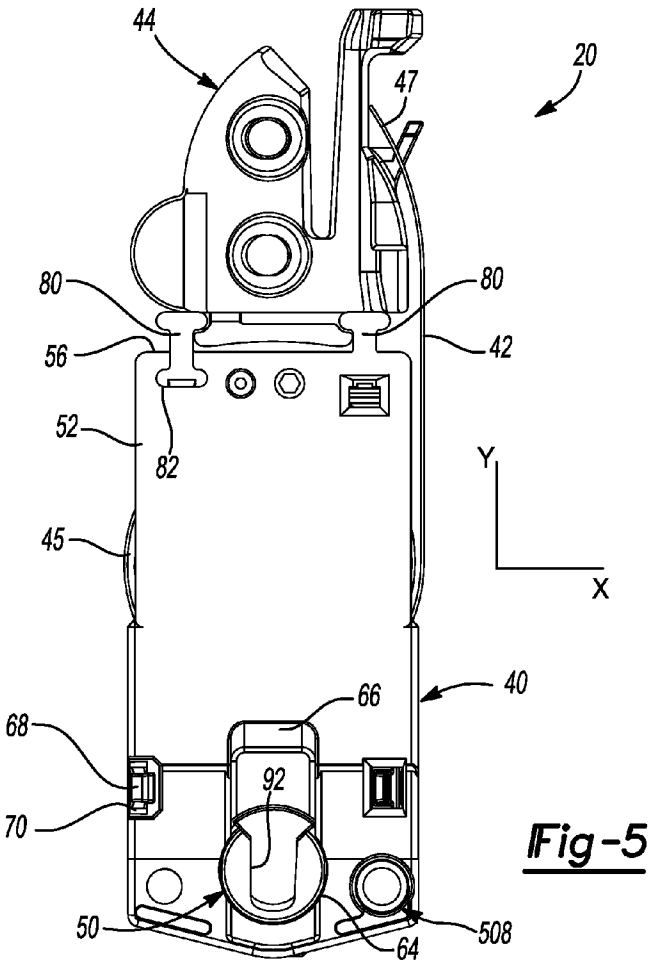
FIG. 5 is a side view of the window balance assembly of FIG. 4.

When the lower sash 14 is tilted relative to the window jamb 16, the pivot bar 22 rotates the receiver 50 toward the orientation shown in FIG. 5, in which the slotted recess 92 is oriented vertically (i.e., along the Y-axis) and is generally aligned with the first slot 66 in the carrier 40. Rotating the receiver 50 in this manner moves the cams 94 out of the arcuate recesses 65 and causes surfaces 95 of the cams 94 to engage portions of the interior faces 54 and force the interior faces 54 of the first and second housing portions 46, 48 axially away from each other in a direction along the Z-axis. As such, portions of the interior faces 54 of the first and second housing portions 46, 48 function as axial cam followers to the surfaces 95 of the cams 94. In this manner, the exterior faces 52 of the first and second housing portions 46, 48 are forced against the first and second walls 28, 30 of the jamb channel 26. Forcing the exterior faces 52 outward against the first and second walls 28, 30 creates friction that may be sufficient to lock the carrier 40 in place relative to the jamb channel 26.

Moreover, as shown in FIG. 6, the first and second housing portions 46, 48 can include apertures 506 that can accommodate optional inserts 508 to increase the friction for locking the carrier 40 in place. In this regard, the inserts 508 are received in the apertures 506 of the housing portions 46, 48, such as by an interference or press fit. The inserts 508 include a head portion 512 having an exterior surface 514. When the insert 508 is installed (FIGS. 4 and 5), the exterior surface 514 of the head portion 512 lies approximately flush with the exterior face 52 of the housing portions 46, 48; that is, it can protrude slightly from the exterior face 52. The exterior surface 514 can include a friction enhancing feature 516 to improve the frictional contact between the carrier 40 and the walls 28, 30 of the jamb channel 26 when the carrier 40 is locked in place. The friction enhancing feature 516 can comprise material or a treatment to the surface 514 that modifies the coefficient of friction of the exterior surface 514.

Accordingly, when the lower sash 14 is in a tilted position, the window balance assembly 20 may be prevented from exerting a net upward force on the lower sash 14. The cams 94 and cam followers are preferably formed to provide full locking engagement with a tilt of the sash of 20 degrees or less with respect to the vertical position, since as the tilt angle increases, the amount of the weight of the sash being supported by the balance decreases such that the balance may raise the sash if not locked in the balance channel. In some embodiments, the rib portions and cam followers are formed to provide full locking engagement with only a small tilt, for example 5 degrees, of the sash. In other embodiments, full locking engagement occurs at tilt angles greater than 5 degrees.

Including two cams 94 on the receiver 50 engaging two cam follower surfaces in the housing improves the distribution of the locking forces from the exterior faces 52 of the carrier 40 across the surfaces 28, 30 of the jamb channel 26 over that of prior art carrier designs having a receiver with a single cam, such as that shown in U.S. Pat. No. 5,353,548.

When the carrier 40 is locked in place within the jamb channel 26, the lower sash 14 can be removed from the window assembly 10 for maintenance or replacement, for example. To remove the lower sash 14, the pivot bars 22 can be removed from the receivers 50 by moving the pivot bars 22 upward out of the slotted recesses 92 and into the first slot 66 in the carriers 40. Thereafter, the pivot bars 22 can be removed from the window balance assemblies 20 so that the lower sash 14 can be removed from the window assembly 10.

The opposite procedure may be employed to install the lower sash 14 into the window assembly 10. That is, with the lower sash 14 tilted relative to the upper sash 12, the pivot bars 22 may be inserted into the first slots 66 in the carrier 40 and lowered into engagement with the slotted recesses 92 in the receivers 50. The lower sash 14 may then be pivoted to the upright position relative to the upper sash 12, which includes rotating the receiver 50. As described above, rotating the receiver 50 allows the first and second housing portions 46, 48 to fully close together, thereby reducing or eliminating friction between the carrier 40 and the jamb channel 26 to allow unrestricted movement of the carrier 40 therein.

Variations of another locking carrier 40' for a tilt-sash counter balance assembly and including an improved locking mechanism is shown in FIGS. 10A-10D, 11, 12A, and 12B. The carrier 40' provides for locking in both the axial (i.e., along the Z-axis) and lateral (i.e., along the X-axis) directions. The dual locking carrier 40' is similar to the carrier 40 previously discussed, and like features are therefore labeled with like reference numbers, as necessary.

The dual locking carrier 40', however, includes a lateral cam follower 500. For example, a lateral cam follower 500 can extend from the interior face 54' of each of the first and second housing portions 46', 48' adjacent to the aperture 64'. A recess 502 in the interior face 54' is located adjacent to the aperture 64' on the side opposite to that of the cam follower 500. In this manner, and because first and second housing portions 46', 48' may be identical components that fit together to form a clamshell-type housing, when the first and second housing portions 46', 48' are assembled together, the lateral cam followers 500 of one of the housing portions may engage the opposed recesses 502 of the other of the housing portions.

The aperture 64' may rotatably engage the receiver 50'. Arcuate recesses 65' formed in the interior faces 54' of the first and second housing portions 46', 48' may be concentric with the aperture 64' and may partially surround the aperture 64'. As described above, the receiver 50' may be rotatable within the aperture 64' to allow the lower sash 14 to pivot about the pivot bar 22 between an upright position and a tilted position. The angular span of the cams 94' may correspond to the angular span of the arcuate recesses 65' that partially surround the aperture 64' in the first and second housing portions 46', 48' such that when the lower sash 14 is in the upright position, the cams 94' fit within the arcuate recesses 65' and the gaps 93' between the cams 94' are positioned adjacent to the lateral cam followers 500.

When the receiver 50' is oriented such that the slotted recess 92' is oriented horizontally relative to the carrier 40', the cams 94' may be fully received within the arcuate recesses 65' (see FIGS. 10A and 10D) and the first and second housing portions 46', 48' are able to fully close together. In this configuration, the carrier 40' is in an unlocked or unrestricted position, such that the carrier 40' may be generally unrestricted from moving upward and downward in the window jamb 16 as the lower sash 14 moves between the open and closed positions.

Figure 10B:
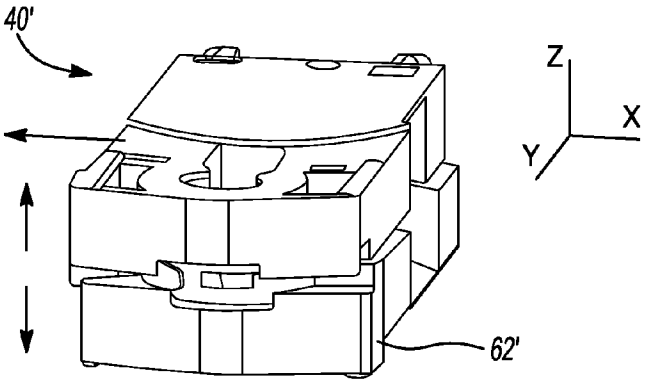
FIGS. 10A through 10D are perspective views of an exemplary dual locking carrier assembly for use with a window balance assembly according to the principles of the present disclosure.
Figure 10D:
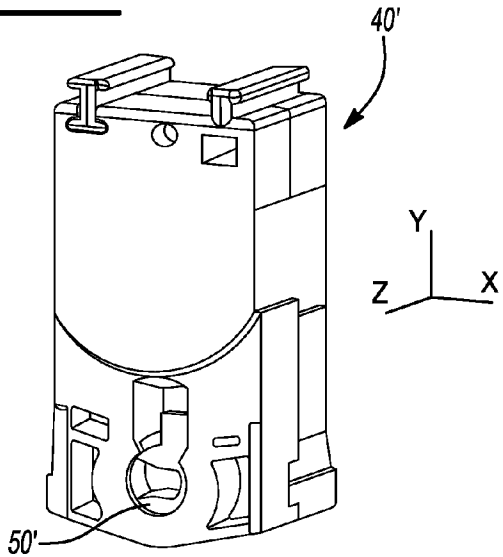
Figure 10C:
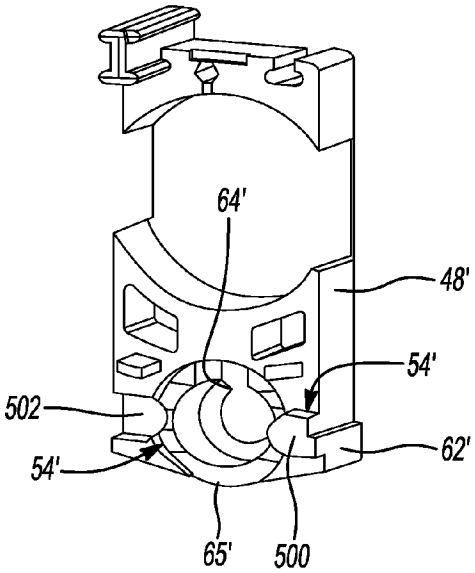
Figure 10A:
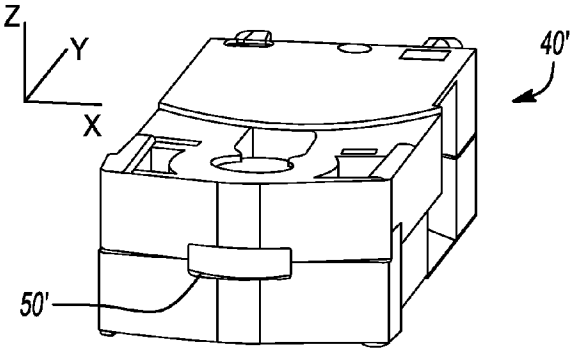
Figure 11:
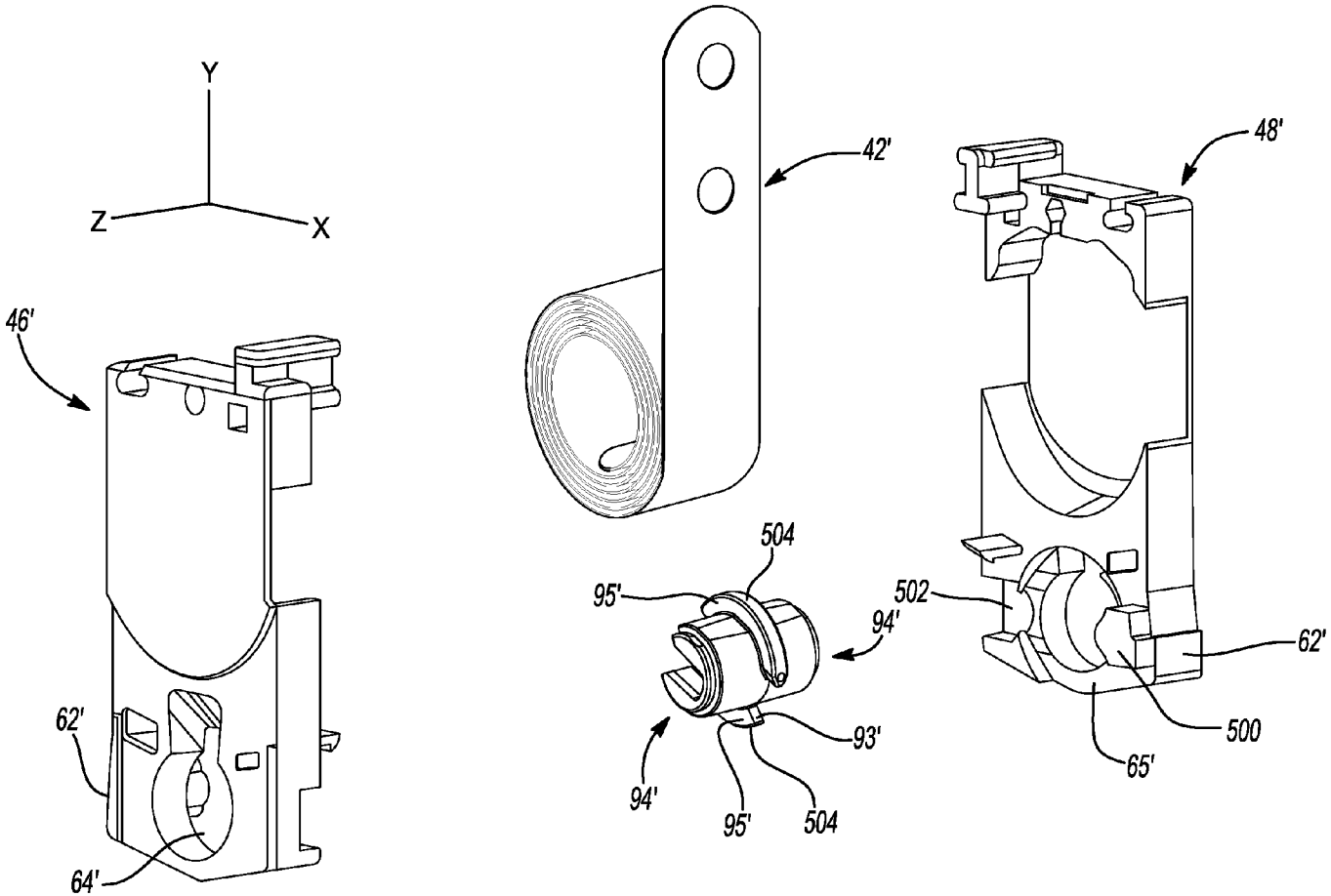
FIG. 11 is an exploded perspective view of the dual locking carrier assembly of FIGS. 10A-10D.

When the lower sash 14 is tilted relative to the window jamb 16, the pivot bar 22 rotates the receiver 50' to lock the carrier, as shown in FIG. 10(B), in which the slotted recess 92' is oriented vertically and is generally aligned with the first slot 66' in the carrier 40'. Rotating the receiver 50' in this manner moves the cams 94' out of the arcuate recesses 65' and causes the face surfaces 95' of the cams 94' to force the interior faces 54' of the first and second housing portions 46', 48' axially away from each other in a direction along the Z-axis. In this manner, the exterior faces 52' of the first and second housing portions 46', 48' are forced against the first and second walls 28, 30 of the jamb channel 26.

In addition, however, the same rotation of the receiver 50' also causes the outer diameter surfaces 504 of the cams 94' to force the cam followers 500 of the first and second housing portions 46', 48' laterally away from each other in a direction along the X-axis. As such, second sides 62' of the first and second housing portions 46', 48' are forced against the third and fourth walls 32, 34 of the jamb channel 26. As a result, the exterior faces 52' and sides 62' are forced outward against all four walls 28, 30, 32, 34 of the jamb channel 26 to create friction that may be sufficient to lock the carrier 40' in place.

Figure 12B:
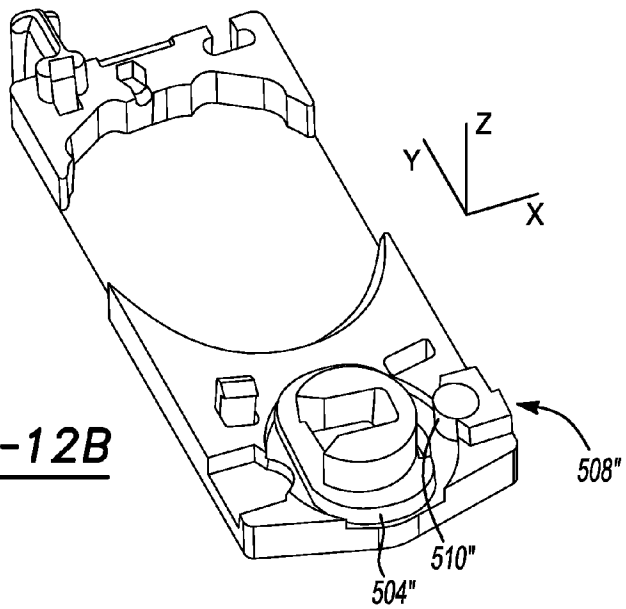
FIGS. 12A, 12B and 12C are perspective views of still another exemplary dual locking carrier assembly for use with a window balance assembly according to the principles of the present disclosure.
Figure 12C:
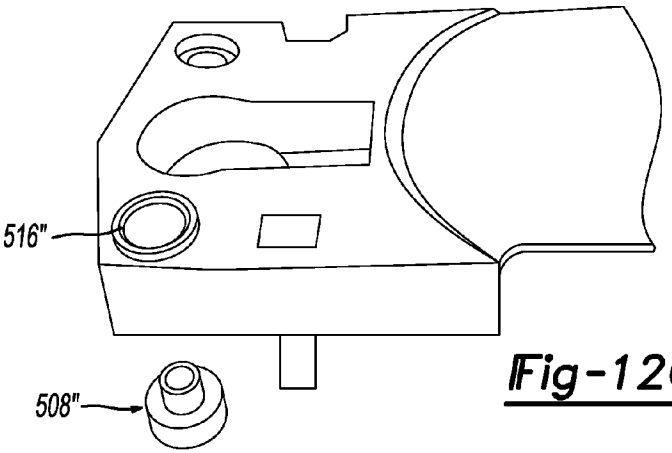
Figure 12A:
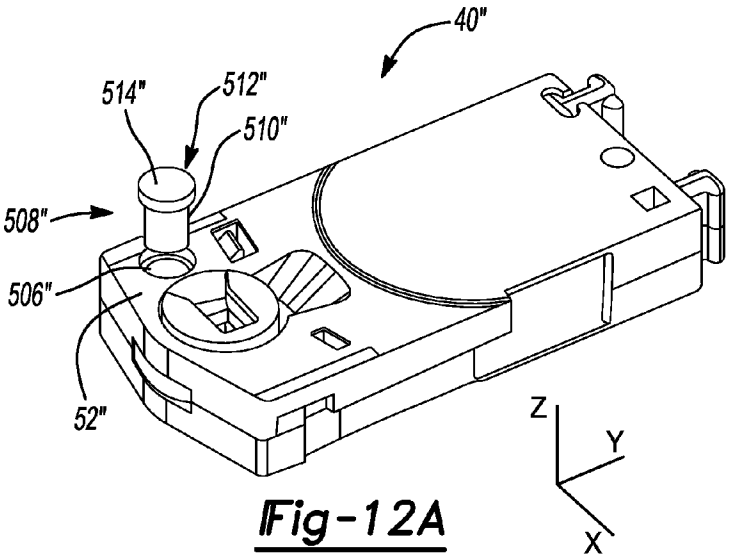

As shown in FIGS. 12A, 12B and 12C, an alternative configuration of a dual locking carrier 40" is shown. In carrier 40", the first and second housing portions 46", 48" may include an aperture 506" in place of a lateral cam follower. The aperture 506" may accommodate an optional insert 508" which may serve as a cam follower for the outer diameter surface 504 of the cam 94". In this manner, the carrier 40" may be easily converted between an axial locking carrier design and a dual locking carrier design.

For example, without the insert 508", the carrier 40" operates substantially as the carrier 40, with the face surfaces 95" of the cams 94" engaging the interior faces 54" of the first and second housing portions 46", 48" when the receiver 50" is rotated, thereby forcing the housing portions 46", 48" axially outwardly along the direction of the Z-axis. The outer diameter surfaces 504" of the cams 94", however, do not engage any portion of the first and second housing portions 46", 48", and therefore do not force the first and second housing portions 46", 48" laterally outwardly along the direction of the X-axis.

With inserts 508" included in the carrier 40", however, the carrier 40" operates substantially as the carrier 40'. In this regard, the inserts 508" are received in the apertures 506" of the housing portions 46", 48", as shown in FIGS. 12A and 12B, such as by an interference or press fit. As best illustrated in FIG. 12B, when installed, the exterior surfaces 510" of the inserts 508" protrude toward the receiver 50". When the receiver 50" is rotated to the position in which the slotted recess 92" is oriented vertically (i.e., along the Y-axis), the outer diameter surfaces 504" of the cams 94" engage the exterior surfaces 510" of the inserts 508". As such, the inserts 508" serve as cam followers for the cams 94", forcing the housing portions 46", 48" laterally outwardly in the direction of the X-axis.

Moreover, the insert 508" includes a head portion 512" that includes an exterior surface 514". When the insert 508" is installed, the exterior surface 514" of the head portion 512" lies approximately flush with the exterior face 52" of the housing portions 46", 48"; that is, it can protrude slightly from the exterior face 52". The exterior surface 514" may include a friction enhancing feature 516" to improve the frictional contact between the carrier 40" and the walls 28, 30 of the jamb channel 26 when the carrier 40" is locked in place. The friction enhancing feature 516" may comprise a material or a treatment to the surface 514" that modifies the coefficient of friction of the exterior surface 514".

Figure 13B:
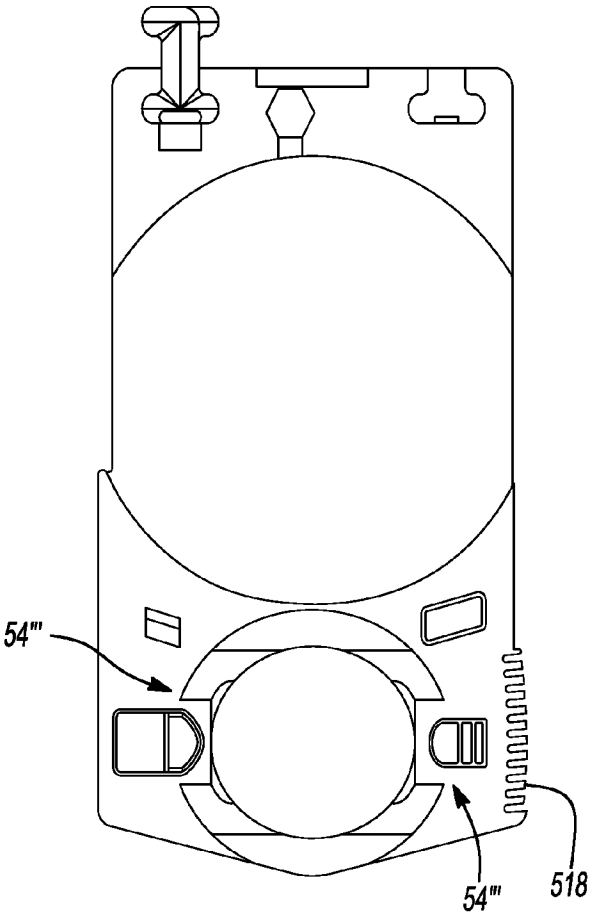
FIG. 13B is a schematic front view of the carrier assembly of FIG. 13A.
Figure 13A:
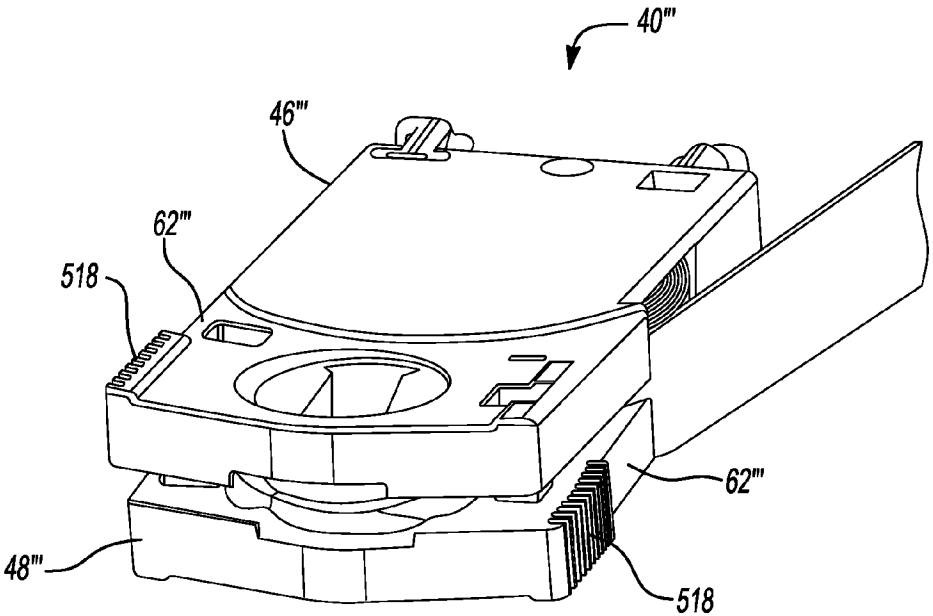
FIG. 13A is a perspective view of yet another exemplary dual locking carrier assembly for use with a window balance assembly according to the principles of the present disclosure.

Still another alternative configuration of a dual locking carrier 40''' is shown in FIGS. 13A and 13B. In this configuration, side surfaces 62''' of the housing portions 46''', 48''' include a friction enhancing feature 518 that engages the walls 32, 34 of the jamb channel 26 when the carrier 40''' is locked in place. The friction enhancing feature 518 may comprise a material or a treatment to the side surfaces 62''' that modifies the coefficient of friction of the side surfaces 62'''. For example, as shown in FIG. 13B, the friction enhancing feature 518 may include a plurality of serrations that has the effect of increasing the coefficient of friction of the side surfaces 62''' that engage the walls 32, 34 of the jamb channel 26.

Figure 14A:
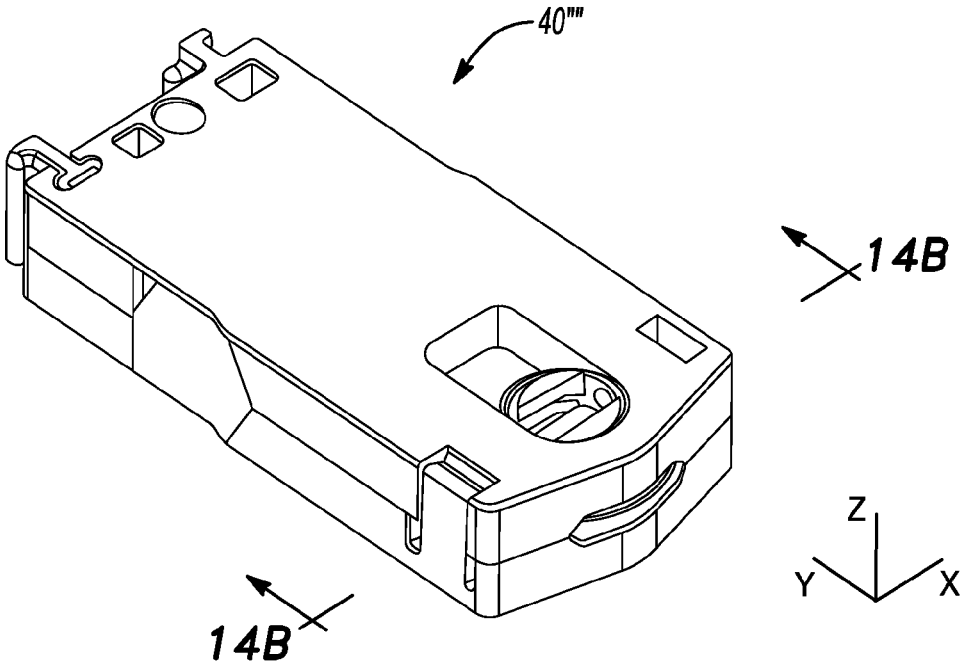
FIG. 14A is a perspective view of another exemplary dual locking carrier assembly for use with a window balance assembly according to the principles of the present disclosure.
Figure 14B:
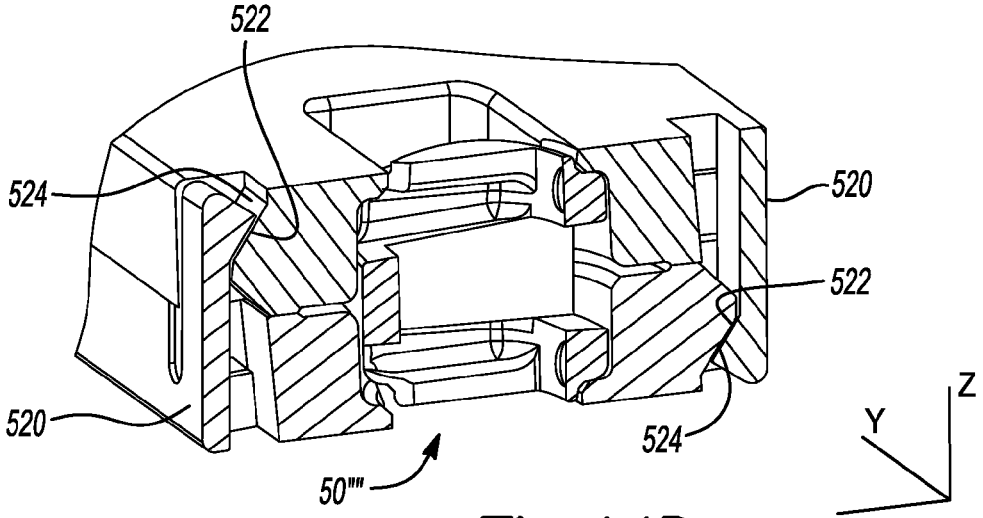
FIG. 14B is a cross-sectional perspective view of the locking carrier assembly of FIG. 14A along the line 14B-14B.

FIGS. 14A and 14B show still another embodiment of a dual locking carrier design 40'''' of the disclosure. In the carrier 40'''', the clamshell-type housings 46'''', 48'''' each include at one lateral side of the aperture 64'''' a cantilevered arm 520 having a cam follower surface 522 and at the opposite lateral side of the aperture 64'''' a cam surface 524. When the carrier 40'''' is assembled, the cam follower surface 522 of the arm 520 of one housing 46'''', 48'''' engages the corresponding cam surface 524 of the other housing 46'''', 48'''', as best seen in FIG. 14B. Then, as the receiver 50'''' is rotated to the locking position (as previously described), the housings 46'''', 48'''' are forced apart in a direction along the Z-axis (also as previously described). This, in turn, causes cam surface 524 to force cam follower surface 522, and consequently cantilevered arm 520, laterally outward in a direction along the X-axis to achieve dual locking in both the axial and lateral directions.

Figure 15:
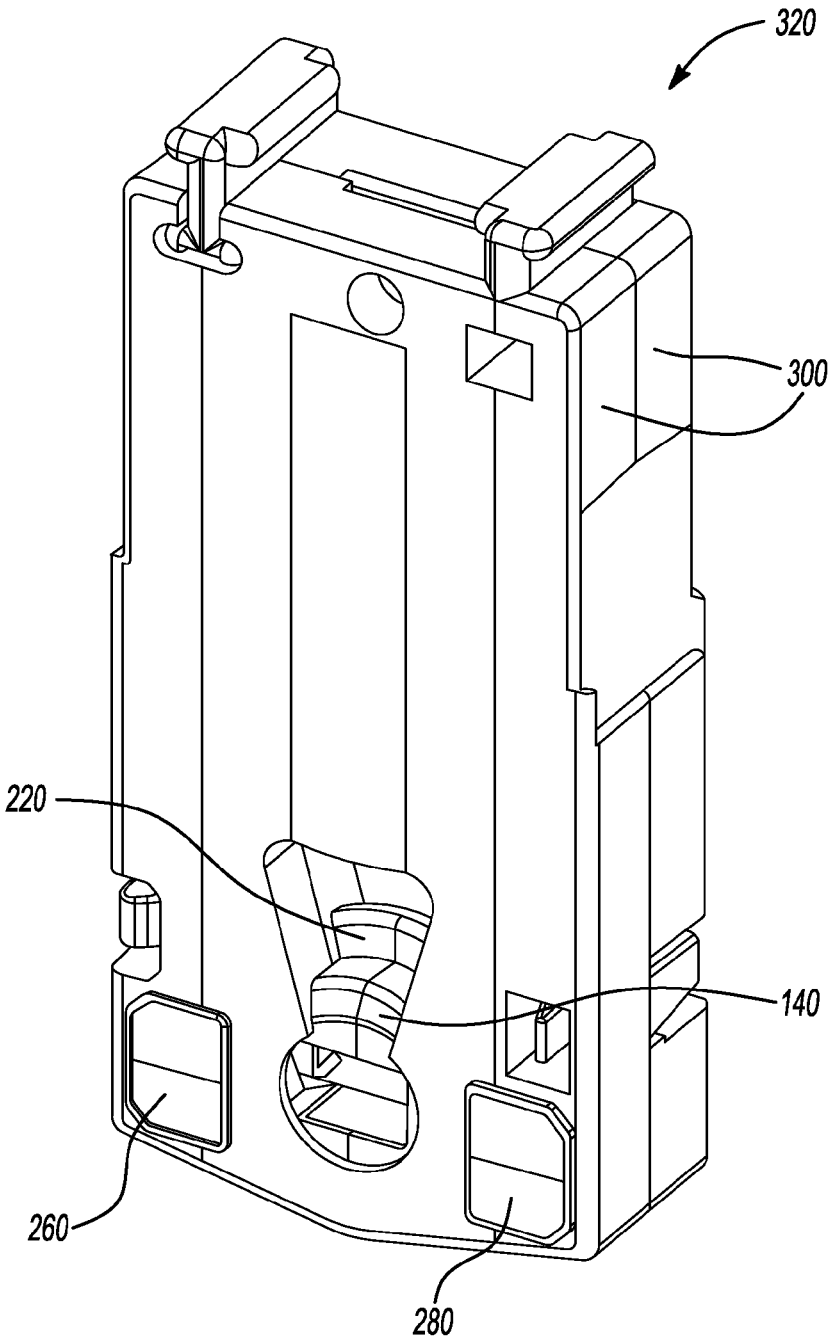
FIG. 15 is a perspective view of another locking carrier assembly for use with a window balance assembly according to the principles of the present disclosure.
Figure 16:
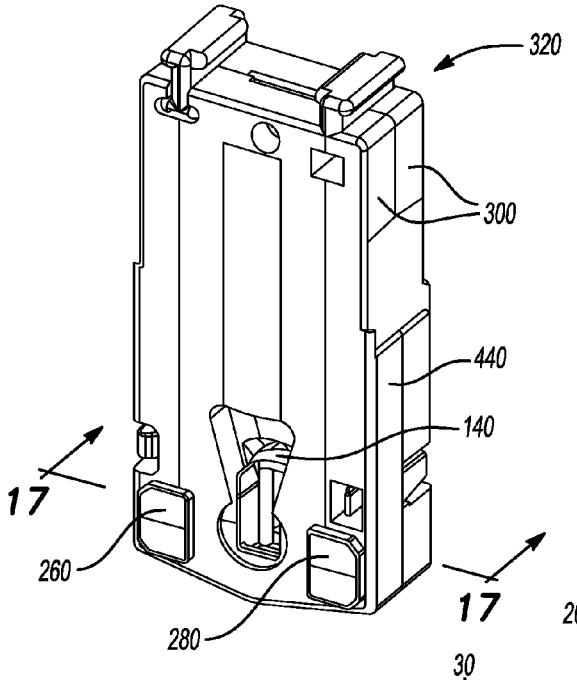
FIG. 16 is another perspective view of the locking carrier assembly of FIG. 15.
Figure 17:
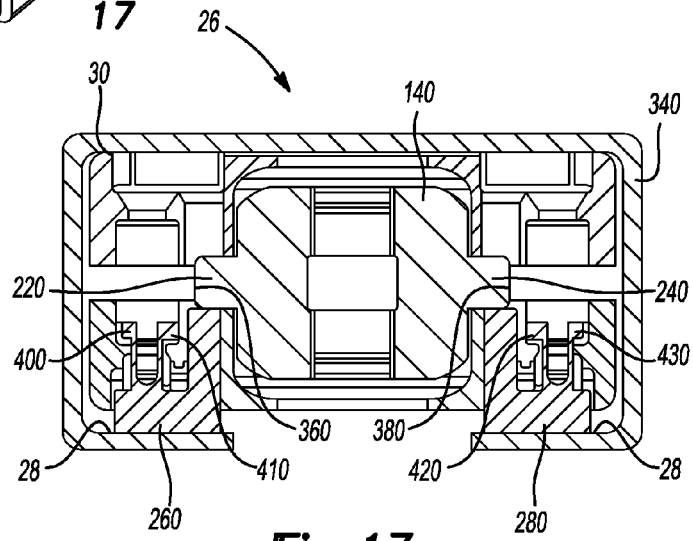
FIG. 17 is a cross-sectional view of the locking carrier assembly of FIG. 16 along the line 17-17.

In yet another embodiment of a locking carrier 320 shown in FIGS. 15-17, one or more locking pads 260, 280 are mounted in an opening in the carrier 320. The locking pads 260, 280 each have a rearward facing surface 360, 380 forming a cam follower. Each cam follower surface 360, 380 may be flat or contoured depending on the shape of the cam surfaces of the receiver 140 and the desired locking result. The locking pad 260, 280 has a forward facing surface extending from the carrier housing 300 in a locked position. A cam surface 220, 240 of the receiver 140 contacting the cam follower 360, 380 drives the locking pad 260, 280 to the locked position. The locking pad 260, 280 is retracted in the carrier 320 in an unlocked position when not driven by the cam surfaces 220, 240 of the receiver 140. In some embodiments, the locking pad 260, 280 has a pair of cam followers, each cam follower contacting one of the cam surfaces of the receiver. The locking pad 260, 280 preferably includes at least one tab for mounting and maintaining the locking pad in an opening of the carrier 320.

FIG. 15 shows a carrier 320 in an unlocked state. The locking pads 260, 280 are retracted within the housing 300 of the carrier 320, because the receiver 140 is oriented with one cam surface 220 upward and another cam surface 240 downward.

FIGS. 16 and 17 show the carrier 320 of FIG. 15 in a locked state. The receiver 140 has been rotated by a quarter turn, or 90 degrees with respect to the orientation in FIG. 15, corresponding to a 90-degree rotation of the sash and pivot bar in an assembled window, such that the cam surfaces 220, 240 are located squarely behind the two locking pads 260, 280, thereby forcing the locking pads to extend past the front of the carrier housing 300. In the locked state, the locking pads 260, 280 contact the surfaces of the front of the shoe channel 28, while the back surface of the shoe body 300 contacts the back of the shoe channel 30 to bind the carrier 320 in the jamb channel 26 and prevent upward or downward movement of the carrier 320 and associated sash when the sash is tilted.

The front surfaces of the cam surfaces 220, 240 of the receiver 140 contact the back surfaces 360, 380 of the locking pads 260, 280, which serve as cam followers, to drive the locking pads 260, 280 outward from the carrier housing 300. In FIG. 17, each locking pad 260, 280 is mounted in the carrier 320 by a pair of tabs 400, 410 and 420, 430, which preferably fit into an opening in the front half 440 of the carrier 320. The tabs 400, 410 and 420, 430 maintain the locking pads 260, 280 in the carrier 320.

In other embodiments of the present invention, the locking pads extend from the back of the shoe to contact the back wall of the shoe channel. In further embodiments, the back and front of the shoe are symmetric with a first pair of locking pads extending from the front of the shoe and a second pair of locking pads extending from the back of the shoe. In still further embodiments of the present invention, a single locking pad is contacted by both ribs of the cam to extend from the back of the shoe. In other embodiments, a single locking pad extends from the back of the shoes, and a pair of locking pads extends from the front of the shoe.

Figure 18:
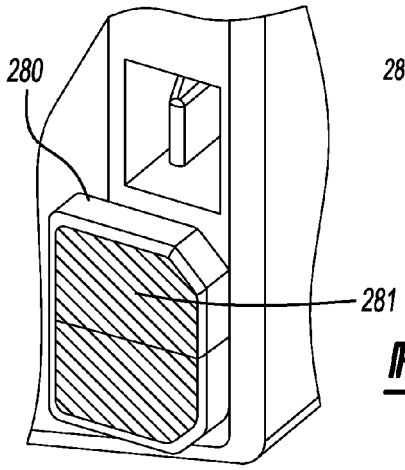
FIG. 18 is an enlarged, partial perspective view showing the locking carrier assembly of FIG. 15 and including a friction enhancing material on the locking pad.

In yet another embodiment, as shown in FIG. 18, one or more locking pads includes a friction enhancing feature 281, such as a friction material that is applied to the contact surfaces of the locking pads 260, 280. The friction material can comprise, for example, fiberglass that is suspended in a resin matrix material that is laminated over the contact surfaces.

Figure 19:
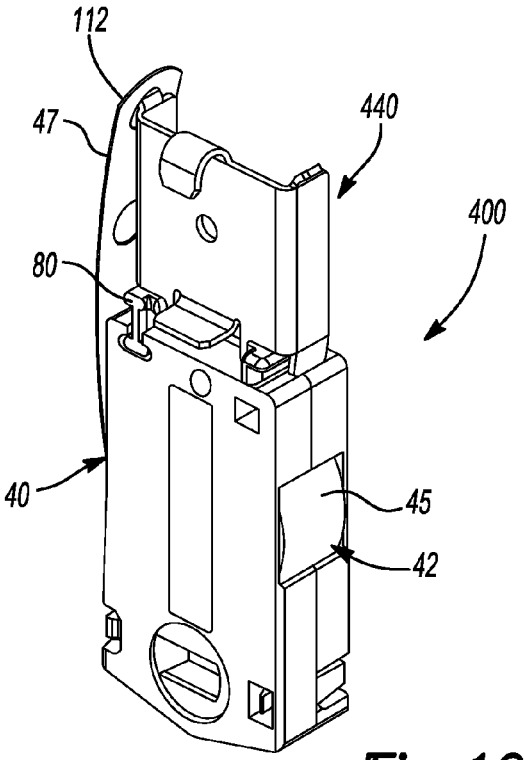
FIG. 19 shows a perspective view of yet another alternative embodiment of a window balance assembly including a locking carrier in an uninstalled configuration.
Figure 21:
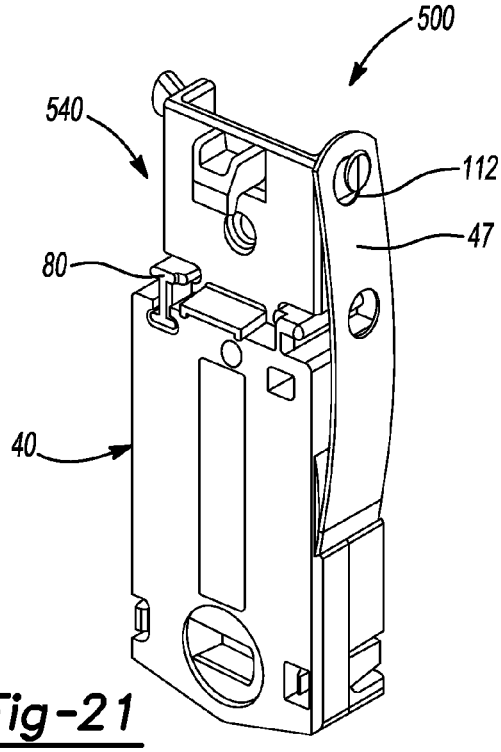
FIG. 21 shows a perspective view of still another alternative embodiment of a window balance assembly including a locking carrier in an uninstalled configuration.
Figure 23:
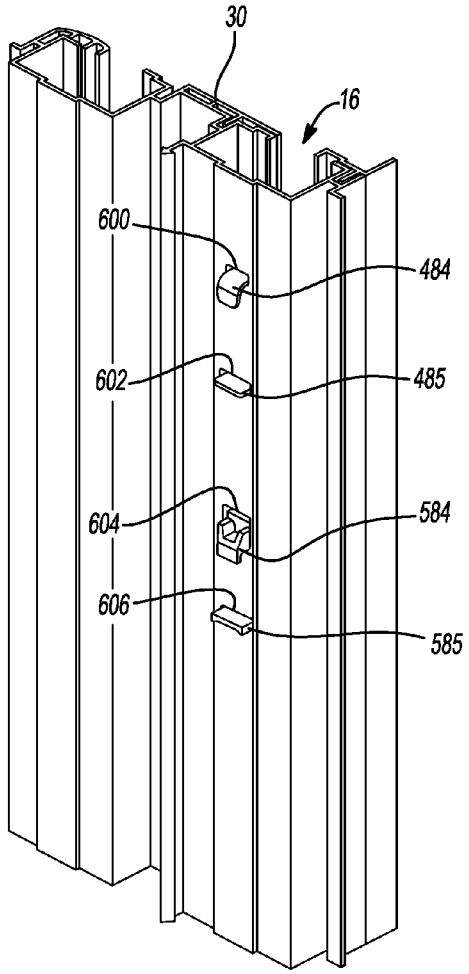
FIG. 23 shows a perspective view of the back side of a jamb channel in which the window balance assemblies of FIGS. 19 and 21 are installed.

Still other alternative embodiments of a window balance assembly according to the disclosure are shown in FIGS. 19, 21 and 23. The window balance assemblies 400 (FIG. 19) and 500 (FIG. 21) may be initially assembled and shipped in an uninstalled or shipping configuration (shown in FIGS. 19 and 21) and may be subsequently installed onto the window assembly 10 (as shown in FIG. 23) and placed in an installed configuration by a window manufacturer, a construction or renovation contractor, or a homeowner, for example.

As previously described, the carrier 40 may engage the lower sash 14 and house a curled portion 45 of the curl spring 42. The mounting bracket 440, 540 may engage an uncurled end portion 47 of the curl spring 42 and may be fixed relative to the window jamb 16. The curl spring 42 may resist being uncurled such that the curl spring 42 exerts an upward force on the carrier 40, thereby biasing the lower sash 14 toward the open position.

Figure 20A:
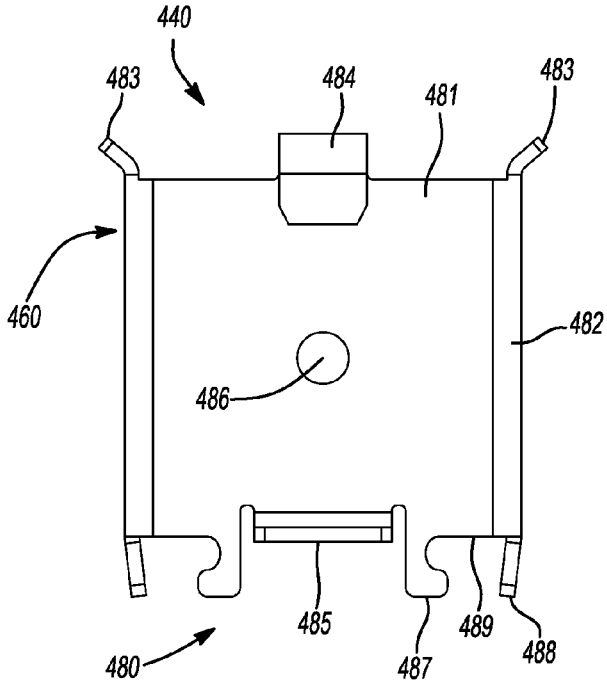
FIGS. 20A and 20B show orthogonal views of an alternative mounting bracket of the window balance assembly of FIG. 19.
Figure 20B:
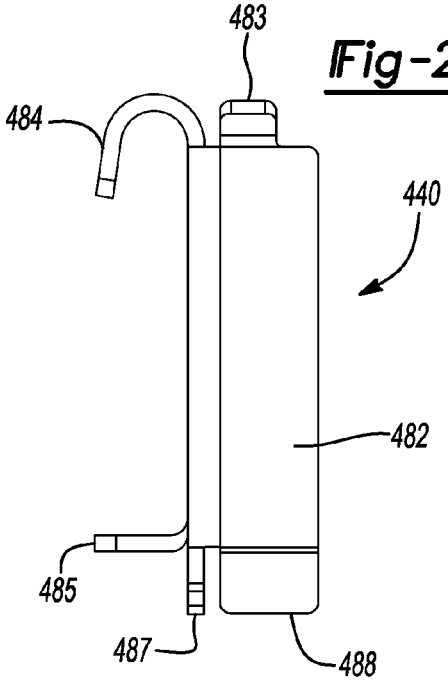

As shown in FIGS. 19, 20A and 20B, the mounting bracket 440 for a balance assembly 400 may be formed from a metal material, for example, and may include a body portion 460 and a lower attachment portion 480. The body portion 460 comprises a planar back wall 481 and two opposed side walls 482, each projecting from the back wall 481 in a generally orthogonal manner. Extending from an upper end of the side wall 482 is a spring attachment portion 483, upon which uncurled end portion 47 of the curl spring 42 may hook or latch to the mounting bracket 440. The spring attachment portion 483 may extend generally upward and outward (relative to the view shown in FIG. 22A) from the body portion 460 and may engage an aperture 112 in the uncurled portion 47 of the curl spring 42. A spring attachment portion 483 can be included on either or both of the side walls 482 of the mounting bracket 440, with the former arrangement accommodating one of a left-handed or right-handed curl spring installation in the carrier, and the latter arrangement accommodating both left-handed and right-handed curl spring installations in the carrier, as shown in FIGS. 20A and 20B.

Included at an upper end of the body portion 460 is a mounting hook 484. The mounting hook 484 extends outwardly from the back wall 481 of the mounting bracket 440 in a direction generally opposite to the direction in which the side walls 482 project from the back wall 481. Projecting outwardly from a lower portion of the back wall 481, but in the same direction as the mounting hook 484, is a tab member 485. The mounting hook 484 and tab member 485 are each operable to engage a corresponding receiving slot 600, 602 in a wall 30 of the jamb channel 16 to co-operably secure the mounting bracket 440 in position in the jamb channel 16, as best seen in FIG. 23.

As can be appreciated, installation of the mounting bracket 440 is achieved by inserting the mounting hook 484 into the upper receiving slot 600 with the mounting bracket 440 in an orientation generally forming an acute angle with the jamb channel 16 wall 30. Thereafter, the mounting bracket 440 is rotated to an orientation generally parallel with the jamb channel 16 wall 30 so that the tab member 485 is inserted into the lower receiving slot 602. Once installed, the mounting bracket 440 is secured in the jamb channel 16 against the vertical forces applied to the balance assembly 400. Additionally, an optional mounting aperture 486 may also be included in the body portion 460 of the mounting bracket 440 and a corresponding fastener may be employed to further secure the mounting bracket 440 to a jamb wall 30.

In an uninstalled or shipping configuration, the mounting bracket 440 is located on top of the carrier 40, where the lower attachment portion 480 of the mounting bracket 440 connects to the upper end of the carrier 40. The lower attachment portion 480 of the mounting bracket 440 may include tapered or curved extension portions 487, 488 that protrude from the back wall 481 and side walls 482 that cooperate with the lower end 489 of the body portion 460 to slidably engage projections 80 of the carrier 40. In this manner, the mounting bracket 440 and carrier 40 are joined together when the balance assembly is in the uninstalled or shipping configuration. Alternatively, a "break-away" or stress riser feature may be included in the lower attachment portion 480 of the mounting bracket 440 to join the mounting bracket 440 with the carrier 40, such as disclosed in International application Publication no. WO 2011/100280 entitled, "Window Balance Assembly," which is assigned to the assignee of the present disclosure. The disclosure of International application Publication no. WO 2011/100280 is hereby incorporated by reference.

Figure 22A:
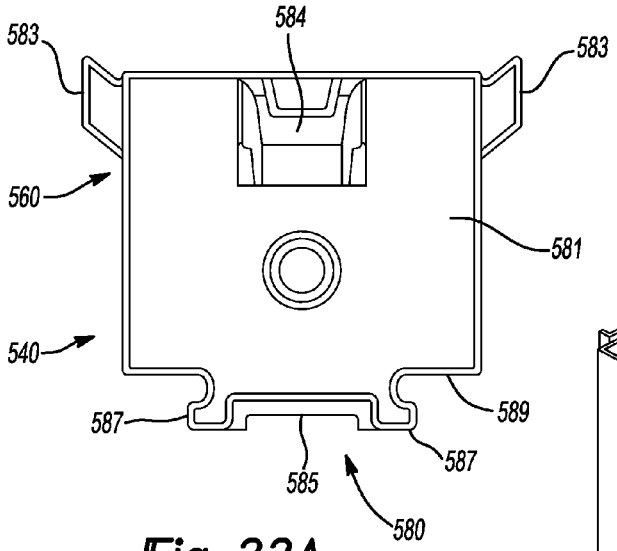
FIGS. 22A and 22B show orthogonal views of another alternative mounting bracket of the window balance assembly of FIG. 21.
Figure 22B:
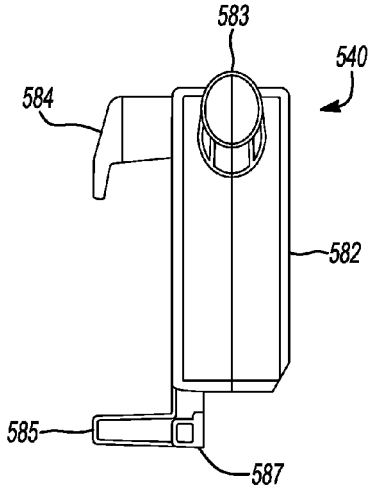

Another alternative window balance assembly 500 is shown in FIG. 21, and its associated mounting bracket 540 is shown in FIGS. 22A and 22B. The mounting bracket 540 for a balance assembly 500 may be formed from a plastic material, such as by molding, for example. In general, the mounting bracket 540 is similar to the mounting bracket 440, as previously described, including a body portion 560 and a lower attachment portion 580. The body portion 560 comprises a planar back wall 581 and two opposed side walls 582, each projecting from the back wall 581 in a generally orthogonal manner. Extending from an upper end of the side wall 582 is a spring attachment portion 583, upon which the curl spring may hook or latch to the mounting bracket 540. The spring attachment portion 583 may extend generally upward and outward (relative to the view shown in FIG. 22A) from the body portion 560 and may engage an aperture 112 in the uncurled portion 47 of the curl spring 42. A spring attachment portion 583 can be included on either or both of the side walls 582 of the mounting bracket 540, with the former arrangement accommodating one of a left-handed or right-handed curl spring installation in the carrier, and the latter arrangement accommodating both left-handed and right-handed curl spring installations in the carrier.

Included at an upper end of the body portion 560 is a mounting hook 584. The mounting hook 584 extends outwardly from the back wall 581 of the mounting bracket 540 in a direction generally opposite to the direction in which the side walls 582 project from the back wall 581. Projecting outwardly from a lower portion of the back wall 581, but in the same direction as the mounting hook 584, is a tab member 585. The mounting hook 584 and tab member 585 are each operable to engage a corresponding receiving slot 604, 606 in a wall 30 of the jamb channel 16 to co-operably secure the mounting bracket 540 in position in the jamb channel 16, as best seen in FIG. 23. As can be appreciated, installation of the mounting bracket 540 is achieved by inserting the mounting hook 584 into the upper receiving slot 604 with the mounting bracket 540 in an orientation generally forming an acute angle with the jamb channel wall 30. Thereafter, the mounting bracket 540 is rotated to an orientation generally parallel with the jamb channel wall 30 so that the tab member 585 is inserted into the lower receiving slot 606. Once installed, the mounting bracket 540 is secured in the jamb channel 16 against the vertical forces applied to the balance assembly. Additionally, an optional mounting aperture 586 may also be included in the body portion 560 of the mounting bracket 540 and a corresponding fastener may be employed to further secure the mounting bracket 540 to a jamb wall 30.

In an uninstalled or shipping configuration, the mounting bracket 540 is located on top of the carrier 40, where the lower attachment portion 560 of the mounting bracket 540 connects to the upper end of the carrier 40. The lower attachment portion 560 of the mounting bracket 540 may include tapered or curved extension portions 587 that protrude from the back wall 581 that cooperate with the lower end 589 of the body portion 560 to slidably engage projections 80 of the carrier 40. In this manner, the mounting bracket 540 and carrier 40 are joined together when the balance assembly is in the uninstalled or shipping configuration. Alternatively, a "breakaway" or stress riser feature may be included in the lower attachment portion of the mounting bracket to join the mounting bracket with the carrier.

The carriers of the window balance assembly are preferably mountable in either a left jam channel or a right jam channel. To this end, the receiver 50 is preferably symmetric so that it can be mounted in either direction in the carrier body. The carrier body is also preferably symmetric to the extent that it can be oriented in either direction in a jamb channel of a window. When the balance is a curl spring balance, the carrier is preferably symmetric to the extent that the curl spring can be mounted in either orientation in the carrier housing.

Although the invention has been described in embodiments for curl spring window balances, the locking mechanism may be used in any type of window balances, including, but not limited to, curl spring balances, block-and-tackle balances, spiral balances, and hybrid balances, within the spirit of the present disclosure. Accordingly, it is to be understood that the embodiments of the invention herein described are merely illustrative of the application of the principles of the invention.

What is claimed is:

1. A moving coil window balance assembly for installation in a window assembly, the window balance assembly comprising:

a carrier;

a curl spring;

a mounting bracket; and wherein the carrier comprises a clamshell-type housing containing the curl spring and a receiver;

wherein the housing comprises opposing first and second housing portions, a first aperture extending through the housing along a first axis and being located proximate a bottom end of the housing, arcuate recesses that at least partially surround the first aperture, and axial cam followers;

wherein the receiver is rotatably engaged in the aperture and comprises a generally cylindrical member including slotted recesses formed in each end and having two symmetric, annular cams extending around a portion of the perimeter of the receiver;

wherein when the receiver is in a first rotational position the cams are received in the recesses and the first and second housing portions are closed against one another at the bottom end; and wherein when the receiver is in a second rotational position the cams engage the axial cam followers and displace the first and second housing portions away from one another at the bottom end of the housing in a direction along the first axis; and wherein the housing further comprises an insert comprising a friction enhancing feature that protrudes from an exterior face of the housing that is perpendicular to the first axis.

2. The moving coil window balance assembly of claim 1, wherein the insert is received in a second aperture in the housing and further comprises a head portion having an exterior surface comprising the friction enhancing feature.

3. The moving coil window balance assembly of claim 1, wherein the mounting bracket comprises:

a body portion comprising a back wall and at least one side wall comprising a spring attachment portion at an upper end thereof for engaging the curl spring;

a mounting hook extending from an upper portion of the back wall;

a tab member extending from a lower portion of the back wall; and an attachment portion for connecting to an upper end of the carrier.

4. A moving coil window balance assembly for installation in a window assembly, the window balance assembly comprising:

a carrier;

a curl spring;

a mounting bracket; and wherein the carrier comprises a clamshell-type housing containing the curl spring and a receiver;

wherein the housing comprises opposing first and second housing portions, a first aperture extending through the housing along a first axis and being located proximate a bottom end of the housing, arcuate recesses that extend at least partially around the first aperture, axial cam followers, and lateral cam followers;

wherein the receiver is rotatably engaged in the aperture and comprises a generally cylindrical member including slotted recesses formed in each end and having two symmetric, annular cams extending around a portion of the receiver;

wherein when the receiver is in a first rotational position the cams are received in the recesses and the first and second housing portions are closed against one another at the bottom end; and wherein when the receiver is in a second rotational position, the receiver engages the axial cam followers and displaces the first and second housing portions away from one another at the bottom end of the housing in a direction along the first axis, and the receiver engages the lateral cam followers and displaces the first and second housing portions away from one another at the bottom end of the housing in a direction along a second axis that is generally perpendicular to the first axis.

5. The moving coil window balance assembly of claim 4, wherein the housing further comprises at least one insert comprising a friction enhancing feature that protrudes from an exterior face of the housing.

6. The moving coil window balance assembly of claim 5, wherein the insert is received in a second aperture in the housing that is perpendicular to the first axis and further comprises a head portion having an exterior surface comprising the friction enhancing feature.

7. The moving coil window balance assembly of claim 4, wherein the mounting bracket comprises:

a body portion comprising a back wall and at least one side wall comprising a spring attachment portion at an upper end thereof for engaging the curl spring;

a mounting hook extending from an upper portion of the back wall;

a tab member extending from a lower portion of the back wall; and an attachment portion for connecting to an upper end of the carrier.

8. A moving coil window balance assembly for installation in a window assembly, the window balance assembly comprising:

a carrier;

a curl spring;

a mounting bracket; and wherein the carrier comprises a clamshell-type housing and a receiver, the housing comprising opposing first and second housing portions and containing the curl spring, the housing including a first aperture extending therethrough along a first axis and located proximate a bottom end thereof and having arcuate recesses that at least partially surround the first aperture, the receiver being rotatably engaged in the aperture;

wherein the first and second housing portions each comprise a second aperture adjacent to the first aperture;

wherein an insert is disposed in each of the second apertures, the insert comprising a lateral cam follower and a friction enhancing feature that protrudes from exterior faces of the first and second housing portions;

wherein the receiver comprises a generally cylindrical member including slotted recesses formed in each end thereof and having two symmetric, annular cams extending around a portion of the perimeter of the receiver;

wherein when the receiver is in a first rotational position the cams are received in the recesses and the first and second housing portions are closed against one another at the bottom end; and wherein when the receiver is in a second rotational position the cams engage interior faces of the first and second housing portions and displace the first and second housing portions away from one another at the bottom end of the housing in a direction along the first axis, and the cams engage the lateral cam followers and displace the first and second housing portions away from one another at the bottom end of the housing in a direction along a second axis that is generally perpendicular to the first axis.

9. The moving coil window balance assembly of claim 8, wherein a side wall of each of the first and second housing portions comprises a friction enhancing feature.

10. The moving coil window balance assembly of claim 9, wherein the friction enhancing feature comprises a plurality of serrations.

11. The moving coil window balance assembly of claim 8, wherein the housing further comprises an insert comprising a friction enhancing feature that protrudes from an exterior face of the housing that is perpendicular to the first axis.

12. The moving coil window balance assembly of claim 11, wherein the insert is received in a third aperture in the housing and further comprises a head portion having an exterior surface comprising the friction enhancing feature.

13. The moving coil window balance assembly of claim 8, wherein the mounting bracket comprises:

a body portion comprising a back wall and at least one side wall comprising a spring attachment portion at an upper end thereof for engaging the curl spring;

a mounting hook extending from an upper portion of the back wall;

a tab member extending from a lower portion of the back wall; and an attachment portion for connecting to an upper end of the carrier.

14. A moving coil window balance assembly for installation in a window assembly, the window balance assembly comprising:

a carrier;

a curl spring;

a mounting bracket; and wherein the carrier comprises a clamshell-type housing and a receiver, the housing comprising opposing first and second housing portions and containing the curl spring, the housing including a first aperture extending therethrough along a first axis and located proximate a bottom end thereof and having arcuate recesses that at least partially surround the first aperture, the receiver being rotatably engaged in the aperture;

wherein the first and second housing portions each comprise a first cam at a first side and a cantilevered arm comprising a cam follower at a second side;

wherein the receiver comprises a generally cylindrical member including slotted recesses formed in each end thereof and having two symmetric, annular second cams extending around a portion of the perimeter of the receiver;

wherein when the receiver is in a first rotational position the second cams are received in the recesses and the first and second housing portions are closed against one another at the bottom end; and wherein when the receiver is in a second rotational position the second cams engage interior faces of the first and second housing portions and displace the first and second housing portions away from one another at the bottom end of the housing in a direction along the first axis and the first cams engage the cam followers and displace the cantilevered arms away from one another in a direction along a second axis that is generally perpendicular to the first axis.

15. The moving coil window balance assembly of claim 14, wherein the housing further comprises an insert comprising a friction enhancing feature that protrudes from an exterior face of the housing that is perpendicular to the first axis.

16. The moving coil window balance assembly of claim 15, wherein the insert is received in a second aperture in the housing and further comprises a head portion having an exterior surface comprising the friction enhancing feature.

17. The moving coil window balance assembly of claim 14, wherein the mounting bracket comprises:

a body portion comprising a back wall and at least one side wall comprising a spring attachment portion at an upper end thereof for engaging the curl spring;

a mounting hook extending from an upper portion of the back wall;

a tab member extending from a lower portion of the back wall; and an attachment portion for connecting to an upper end of the carrier.

18. A moving coil window balance assembly for installation in a window assembly, the window balance assembly comprising:

a carrier;

a curl spring;

a mounting bracket;

wherein the carrier comprises a housing and a receiver, the housing comprising a first aperture extending therethrough along a first axis and located proximate a bottom end thereof, the receiver being rotatably engaged in the aperture;

wherein the housing has two openings near the first aperture, two locking pads mounted in the openings, each locking pad having a rear cam follower and a forward surface;

wherein the receiver comprises a generally cylindrical member including slotted recesses formed in each end thereof and having two annular cams extending around a portion of the perimeter of the receiver; and wherein when the receiver is in a second rotational position the cams engage the cam followers of the locking pads and the locking pads are in a second extended position wherein the forward surfaces extend from the housing.

19. The moving coil window balance assembly of claim 18, wherein the forward surfaces comprise a friction enhancing feature.

20. A moving coil window balance assembly for installation in a window jamb of a window assembly, the window balance assembly comprising:

a carrier housing a curl spring and comprising means for locking the carrier in the window jamb in both an axial direction and a lateral direction; and a mounting bracket engaged with the curl spring.

21. The moving coil window balance assembly of claim 20, wherein the mounting bracket comprises:

a body portion comprising a back wall and at least one side wall comprising a spring attachment portion at an upper end thereof for engaging the curl spring;

a mounting hook extending from an upper portion of the back wall;

a tab member extending from a lower portion of the back wall; and an attachment portion for slidably connecting to an upper end of the carrier.

* * * * *